US012234589B2

(12) United States Patent
Lee et al.

(10) Patent No.: US 12,234,589 B2
(45) Date of Patent: Feb. 25, 2025

(54) LAUNDRY TREATING APPARATUS AND METHOD FOR CONTROLLING THE SAME

(71) Applicant: LG ELECTRONICS INC., Seoul (KR)

(72) Inventors: Sunho Lee, Seoul (KR); Youngjong Kim, Seoul (KR); Dongcheol Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 630 days.

(21) Appl. No.: 17/401,776

(22) Filed: Aug. 13, 2021

(65) Prior Publication Data

US 2022/0049397 A1 Feb. 17, 2022

(30) Foreign Application Priority Data

Aug. 14, 2020 (KR) ..... 10-2020-0102587

(51) Int. Cl.
*D06F 33/36* (2020.01)
*D06F 23/04* (2006.01)
(Continued)

(52) U.S. Cl.
CPC ..... *D06F 33/36* (2020.02); *D06F 23/04* (2013.01); *D06F 33/38* (2020.02); *D06F 33/48* (2020.02); *D06F 37/24* (2013.01); *D06F 37/40* (2013.01); *D06F 39/02* (2013.01); *D06F 2103/02* (2020.02); *D06F 2103/14* (2020.02)

(58) Field of Classification Search
CPC ..... D06F 13/02; D06F 21/06; D06F 21/08; D06F 23/04; D06F 33/34; D06F 33/36; D06F 33/38; D06F 33/48; D06F 37/24; D06F 37/40
See application file for complete search history.

(56) References Cited

U.S. PATENT DOCUMENTS 4,411,664 A * 10/1983 Rickard ..... D06F 34/16 68/12.14
4,787,220 A 11/1988 Noh
5,325,677 A 7/1994 Payne et al.
2005/0223754 A1* 10/2005 Choi ..... D06F 37/304 68/3 R (Continued)

FOREIGN PATENT DOCUMENTS

CN 1381634 11/2002
GB 1467376 A * 3/1977 ..... D06F 37/203
KR 100273402 12/2000

OTHER PUBLICATIONS

International Search Report and Written Opinion in International Appln. No. PCT/KR2021/010571, dated Dec. 8, 2021, 10 pages.

*Primary Examiner* — David G Cormier
(74) *Attorney, Agent, or Firm* — Fish & Richardson P.C.

(57) ABSTRACT

A laundry treating apparatus includes a drum and a rotator. The rotator includes a bottom portion positioned on a bottom surface of the drum, and a pillar protruding upward from the bottom portion and having a blade disposed on an outer circumferential surface thereof. A controller controls a driver such that the rotator performs an ascending and descending motion for forming an ascending water flow or a descending water flow at least once in a washing cycle of laundry. The controller performs a method for controlling the laundry treating apparatus and controls the driver such that a rotation in one direction and a rotation in the other direction of the rotator are performed by different amounts of rotation in the ascending and descending motion.

18 Claims, 20 Drawing Sheets

(51) Int. Cl.

| | |
|---|---|
| ***D06F 33/38*** | (2020.01) |
| ***D06F 33/48*** | (2020.01) |
| ***D06F 37/24*** | (2006.01) |
| ***D06F 37/40*** | (2006.01) |
| ***D06F 39/02*** | (2006.01) |
| *D06F 103/02* | (2020.01) |
| *D06F 103/14* | (2020.01) |

(56) References Cited

U.S. PATENT DOCUMENTS

| | | | | |
|---|---|---|---|---|
| 2006/0016021 | A1* | 1/2006 | Kim | D06F 35/006 8/158 |
| 2007/0062224 | A1 | 3/2007 | Belle et al. | |
| 2012/0125055 | A1* | 5/2012 | Lee | D06F 39/028 68/17 R |

* cited by examiner

LAUNDRY TREATING APPARATUS AND METHOD FOR CONTROLLING THE SAME

CROSS-REFERENCE TO RELATED APPLICATIONS

This application claims the benefit of Korean Patent Application No. 10-2020-0102587, filed on Aug. 14, 2020, which is hereby incorporated by reference as if fully set forth herein.

BACKGROUND

Field

The present disclosure relates to a laundry treating apparatus, and more particularly, to a laundry treating apparatus having a rotator disposed in a drum, and a method for controlling the same.

Discussion of the Related Art

A laundry treating apparatus is an apparatus that puts clothes, bedding, and the like (hereinafter, referred to as laundry) into a drum to remove contamination from the laundry. The laundry treating apparatus may perform processes such as washing, rinsing, dehydration, drying, and the like. The laundry treating apparatuses may be classified into a top loading type laundry treating apparatus and a front loading type laundry treating apparatus based on a scheme of putting the laundry into the drum.

The laundry treating apparatus may include a housing forming an appearance of the laundry treating apparatus, a tub accommodated in the housing, a drum that is rotatably mounted inside the tub and into which the laundry is put, and a detergent feeder that feeds detergent into the drum.

When the drum is rotated by a motor while wash water is supplied to the laundry accommodated in the drum, dirt on the laundry may be removed by friction with the drum and the wash water.

In one example, a rotator may be disposed inside the drum to improve a laundry washing effect. The rotator may be rotated inside the drum to form a water flow, and the laundry washing effect may be improved by the rotator.

Specifically, the rotator may include a pillar extending in a direction parallel to a rotation shaft of the drum, and a blade that forms a water flow when the pillar rotates may be disposed on an outer circumferential surface of the pillar.

In relation, U.S. Pat. No. 839,997 discloses a rotator including a blade extending in a zigzag form in some sections and extending in parallel with the longitudinal direction of a pillar in the remaining sections.

In the rotator of U.S. Pat. No. 839,997, the blade extends in the zigzag form in some sections to reduce energy consumed during rotation. In this shape, it is difficult to form an ascending water flow in which water ascends or a descending water flow in which water descends during the rotation.

In one example, U.S. Pat. No. 5,301,523 discloses a laundry treating apparatus in which a rotator is rotated alternately in one direction and in the other direction.

The rotator of U.S. Pat. No. 5,301,523 prevents a twisting of laundry and disperses the laundry through the alternating rotation in said one direction and in the other direction rotation. However, it is difficult to form a three-dimensional water flow using a blade, such as an ascending water flow or a descending water flow.

In one example, Korean Patent No. 10-2012-0082759 discloses a laundry treating apparatus in which a rotator rotates alternately in one direction and in the other direction, and discloses a control method through which the rotation in said one direction and the rotation in the other direction of the rotator may be controlled at different rotation speeds or rotation times.

Korean Patent No. 10-2012-0082759 aims to prevent the twisting phenomenon of the laundry and improve a washing efficiency through the rotations of the rotator in said one direction and in the other direction. However, it is difficult to form the three-dimensional water flow using a shape of the blade or to form the water flow using the rotation in said one direction and the rotation in the other direction.

The formation of the three-dimensional water flow in which ascending or descending of water is induced through the rotation of the rotator may improve the washing efficiency by increasing an effect of agitating the laundry and the water. Furthermore, performing various rotation motions including the rotation in said one direction and the rotation in the other direction by the rotator may generate various effects as well as improve the washing efficiency through the three-dimensional water flow formation, which is an important task in the present technical field.

SUMMARY

Embodiments of the present disclosure are intended to provide a laundry treating apparatus that may effectively improve a washing efficiency by efficiently utilizing a rotator that forms a three-dimensional water flow.

In addition, embodiments of the present disclosure are intended to provide a laundry treating apparatus that may form a three-dimensional water flow while improving a twisting phenomenon of laundry through a rotation motion of a rotator including rotations in one direction and in the other direction.

In addition, embodiments of the present disclosure are intended to provide a laundry treating apparatus that may implement various effects by utilizing various rotation motions of a rotator in a washing cycle of laundry.

In addition, embodiments of the present disclosure are intended to provide a method for controlling a laundry treating apparatus that may effectively utilize various rotation motions of a rotator in a washing cycle of laundry.

When there is a rotator that forms a water flow inside a drum of a laundry treating apparatus, the rotator may be decelerated by adjusting an amount of rotation of the rotator by a driver in a left and right direction during agitation in the left and right direction, for example, a rotation angle or adjusting a gear ratio.

However, in one embodiment of the present disclosure, the rotator disposed in the drum may include an inclined blade, and an ascending and descending motion of the rotator may be implemented by placing a deviation in amounts of rotation of rotation in one direction and rotation in the other direction using water flow characteristics based on an inclination of the blade.

That is, one embodiment of the present disclosure may be a laundry treating apparatus in a form of a top loader, and the rotator may perform three-dimensional washing in which a water flow ascends and descends through the inclined blade.

The laundry treating apparatus in the form of the top loader may cause friction in laundry or the water flow may pass through the laundry, so that washing of the laundry of clothes may be performed. A top loader scheme may be distinguished as flat washing, and there is room for damage to the laundry during the washing, but a washing time may be short and a washing cost may be high.

One embodiment of the present disclosure may improve advantages and ameliorate disadvantages of flat washing by establishing a motion strategy of the rotator having the inclined blade.

In one embodiment of the present disclosure, as a rotation motion of the rotator, a motion in consideration of a normal rotation scheme and ascending and descending of a water flow may be presented. In a general motion, the rotator may perform repeated rotations in which an amount of rotation of the driver, that is, a rotation angle of the rotator is constant in one direction and in the other direction.

In addition, in a power motion of the rotation motions, the rotator is rotated in a manner in which an angle of agitation in said one direction and the other direction, that is, in a left and right direction becomes large, large, small, and small to suppress a curling phenomenon of laundry and suppress vibration while strengthening a flow of the laundry and the water flow.

In a basket motion of the rotation motions, the rotator and the drum may be controlled to be rotated in the same rotation direction, and to have the same angle of the agitation in the left and right direction. In an alpha motion of the rotation motions, the rotator may rotate while having the same rotation direction as the drum, and may be rotated in either of said one direction or the other direction.

In one example, in one embodiment of the present disclosure, the rotation motions may include an ascending and descending motion, and the ascending and descending motion may include an ascending motion and a descending motion. The ascending motion is a rotation motion that forms an ascending water flow, and a descending motion is a rotation motion that forms a descending water flow.

In the ascending motion, the rotator may perform a rotation in the other direction after a rotation in said one direction, and the rotation in said one direction may have a larger rotation angle than the rotation in the other direction. In the descending motion, the rotator may perform the rotation in said one direction after the rotation in the other direction, and the rotation in the other direction may have a larger rotation angle than the rotation in said one direction.

One embodiment of the present disclosure may perform an optimal washing course based on a material, a moisture content, and a load amount of the laundry in a washing cycle through the various rotation motions as described above. One embodiment of the present disclosure may perform three-dimensional water flow formation and the rotation motion that are not able to be implemented with a rotator including a blade extending in a vertical direction.

Such laundry treating apparatus according to an embodiment of the present disclosure may include a tub, a drum, a rotator, a driver, and a controller. The tub may provide therein a space for water to be stored, a drum may be disposed inside the tub, and may have an open top surface for inserting laundry therethrough, a rotator may be rotatably installed on a bottom surface of the drum, a driver may be constructed to provide a rotational force to the rotator, and a controller may control the driver.

The rotator may include a bottom portion positioned on the bottom surface of the drum, and a pillar protruding upward from the bottom portion and having a blade disposed on an outer circumferential surface thereof. The blade may extend obliquely with respect to a longitudinal direction of the pillar to form an ascending water flow when the rotator rotates in one direction and form a descending water flow when the rotator rotates in the other direction.

The controller may control the driver such that the rotator performs an ascending and descending motion for forming the ascending water flow or the descending water flow at least once in a washing cycle of the laundry, The controller may control the driver such that the rotation in said one direction and the rotation in the other direction are performed by different amounts of rotation in said one cycle of the ascending and descending motion.

The blade may include a plurality of blades disposed to be spaced apart from each other along a circumferential direction of the pillar, wherein the blade extends from a lower end to an upper end of the pillar while being inclined toward the other direction with respect to the longitudinal direction of the pillar.

The ascending and descending motion may include an ascending motion for forming the ascending water flow, and the controller may control the driver such that, in the ascending motion, the rotator is rotated in said one direction by a first amount of rotation, and rotated in the other direction by a second amount of rotation less than the first amount of rotation.

The controller may control the driver such that the rotator rotates in the other direction after rotating in said one direction in the ascending motion.

The laundry treating apparatus may further include a detergent feeder constructed to supply detergent to the tub, the washing cycle may include a cleaning process for supplying the detergent to the tub from the detergent feeder and removing foreign substances from the laundry, and the controller may control the driver such that the rotator performs the ascending motion at least once within a first reference time after the cleaning process starts.

The laundry treating apparatus may further include a water supply constructed to provide water to the tub, the washing cycle may further include a rinsing process for supplying water to the tub from the water supply and discharging the foreign substances from the tub after the cleaning process, and the controller may control the driver such that the rotator performs the ascending motion at least once within a second reference time after the rinsing process starts.

The washing cycle may include a water supply process for supplying water into the tub through the water supply at least once, and the controller may control the driver such that the rotator performs the ascending motion at least once within a third reference time after the water supply process is terminated.

The washing cycle may include a distribution determination process for the controller to determine uniformity of distribution of the laundry inside the drum at least once, and the controller may control the driver such that, when the uniformity of distribution is equal to or less than a reference uniformity in the distribution determination process, the rotator performs the ascending motion at least once after the distribution determination process.

The ascending and descending motion may include a descending motion for forming the descending water flow, and the controller may control the driver such that, in the descending motion, the rotator rotates by a third amount of distribution rotation in the other direction and rotates by a fourth amount of rotation less than the third amount of distribution rotation in said one direction.

The controller may control the driver such that, only when an amount of water supplied to the tub during the washing cycle is equal to or greater than a reference water supply amount, the rotator performs the descending motion at least once.

The controller may control the driver such that the rotator performs a power motion for forming a water flow stronger than in the ascending and descending motion at least once in the washing cycle, and the controller may control the driver such that the rotator performs a strong rotation motion of rotating by a fifth amount of rotation in each of said one direction and in the other direction, and a weak rotation motion of rotating by a sixth amount of rotation less than the fifth amount of rotation in each of said one direction and in the other direction consecutively in one cycle of the power motion.

The controller may control the driver such that the rotator performs the weak rotation motion after performing the strong rotation motion in the power motion.

The controller may control the driver such that, in the power motion, the rotator is rotated by the fifth amount of rotation in either of said one direction or the other direction, then, is rotated by the fifth amount of rotation in the remaining direction, then is rotated by the sixth amount of rotation in either of said one direction or the other direction, and then, is rotated by the sixth amount of rotation in the remaining direction.

In one embodiment of the present disclosure, the laundry treating apparatus may further include a detergent feeder constructed to supply detergent to the tub, and the washing cycle may include a cleaning process for supplying the detergent to the tub from the detergent feeder and removing foreign substances from the laundry, and a rinsing process for supplying water to the tub from the water supply and discharging the foreign substances from the tub.

The controller may control the driver such that the rotator performs the power motion at least once in the cleaning process or in the rinsing process.

The ascending and descending motion may include an ascending motion for forming the ascending water flow, and the washing cycle may include a water supply process for supplying water into the tub through the water supply at least once.

The controller may control the driver such that the rotator performs the ascending motion at least once within a first reference time after the water supply process is terminated, and performs the power motion at least once after the first reference time.

The ascending and descending motion may include a descending motion for forming the descending water flow, and the controller may control the driver such that, when the amount of water supplied to the tub from the water supply is equal to or greater than the reference water supply amount, the rotator replaces at least one cycle of the power motion performed when the water supply amount is less than the reference water supply amount with the descending motion.

The drum may be rotatably disposed inside the tub, the driver may be constructed to provide the rotational force to each of the rotator and the drum, and the controller may control the driver such that a basket motion for the rotator and the drum to rotate together by a seventh amount of rotation in each of said one direction and the other direction is performed at least once in the washing cycle.

In one embodiment of the present disclosure, the laundry treating apparatus may further include a first rotation shaft connected to the drum, a second rotation shaft connected to the rotator, and a gear set.

The gear set may be connected to the driver, the first rotation shaft, and the second rotation shaft to transmit power of the driver to the first rotation shaft and the second rotation shaft, and may include a clutch element constructed to selectively constrain the first rotation shaft to the second rotation shaft.

The controller may control rotation directions of the drum and the rotator by controlling the clutch element.

The washing cycle may include a dehydration process for removing moisture from the laundry of the drum, and the controller may control the driver such that the drum and the rotator perform the basket motion together in the dehydration process.

The controller may control the driver such that an alpha motion for the rotator and the drum to rotate together by an eighth amount of rotation in one of said one direction and the other direction is performed at least once in the washing cycle.

The washing cycle may include a dehydration process for removing moisture from the laundry inside the drum, and the controller may control the driver such that the drum and the rotator perform the alpha motion together in the dehydration process.

In one example, a laundry treating apparatus according to an embodiment of the present disclosure may include a tub for providing therein a space for water to be stored, a drum rotatably disposed inside the tub, wherein the drum includes an open top surface for inserting laundry therethrough, a rotator rotatably installed on a bottom surface of the drum, and a driver constructed to rotate the rotator.

The rotator may include a bottom portion positioned on the bottom surface of the drum, and a pillar protruding upward from the bottom portion and having a blade disposed on an outer circumferential surface thereof. The blade may extend obliquely with respect to a longitudinal direction of the pillar to form an ascending water flow or a descending water flow based on a rotation direction of the rotator.

The driver may rotate the rotator such that the rotator performs an ascending and descending motion for forming the ascending water flow or the descending water flow at least once. In the ascending and descending motion, the driver may rotate the rotator such that the rotator rotates by different amounts of rotation along one direction and the other direction.

In one example, a method for controlling a laundry treating apparatus according to an embodiment of the present disclosure may include a washing operation of performing at least one of a cleaning operation of removing foreign substances from laundry inserted into a drum, a rinsing operation of discharging foreign substances from a tub after the cleaning operation, and a dehydration operation of removing moisture from the laundry after the rinsing operation, In the washing operation, the controller may control a driver such that a rotator performs an ascending and descending motion for forming an ascending water flow or a descending water flow. In the ascending and descending motion, the controller may control the driver such that the rotator performs a rotation in one direction and a rotation in the other direction independently, and the rotation in said one direction and the rotation in the other direction have different amounts of rotation.

Embodiments of the present disclosure may provide the laundry treating apparatus that may effectively improve the washing efficiency by efficiently utilizing the rotator that forms the three-dimensional water flow.

In addition, embodiments of the present disclosure may provide the laundry treating apparatus that may form the three-dimensional water flow while improving the twisting phenomenon of the laundry through the rotation motion of the rotator including the rotations in said one direction and in the other direction.

In addition, embodiments of the present disclosure may provide the laundry treating apparatus that may implement the various effects by utilizing the various rotation motions of the rotator in the washing cycle of the laundry.

In addition, embodiments of the present disclosure may provide the method for controlling the laundry treating apparatus that may effectively utilize the various rotation motions of the rotator in the washing cycle of the laundry.

DESCRIPTION OF SPECIFIC EMBODIMENTS

Figure 1:
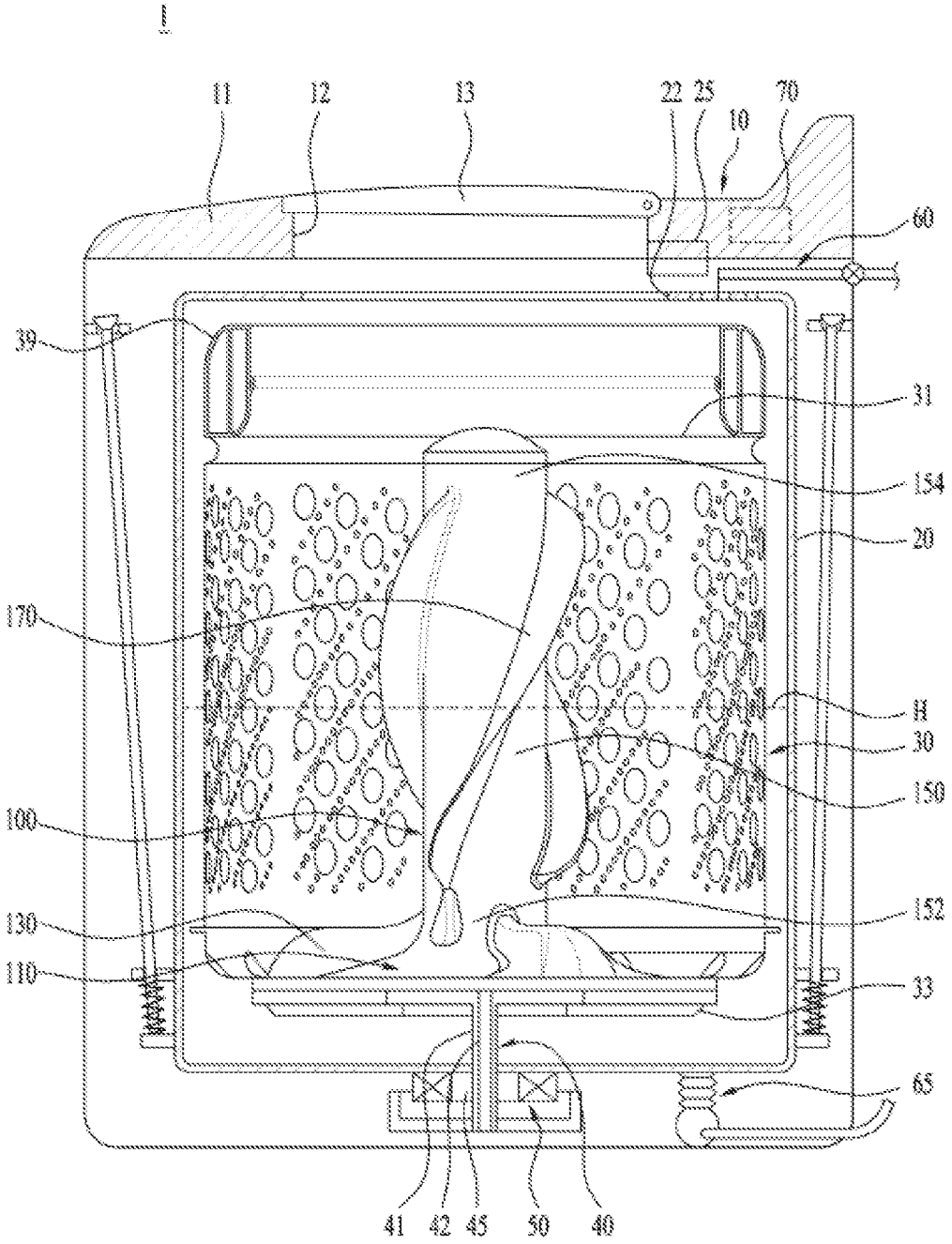
FIG. 1 is a view showing an interior of a laundry treating apparatus according to an embodiment of the present disclosure.

Hereinafter, an embodiment of the present disclosure will be described in detail with reference to the accompanying drawings such that a person having ordinary knowledge in the technical field to which the present disclosure belongs may easily implement the embodiment.

However, the present disclosure is able to be implemented in various different forms and is not limited to the embodiment described herein. In addition, in order to clearly describe the present disclosure, components irrelevant to the description are omitted in the drawings. Further, similar reference numerals are assigned to similar components throughout the specification.

Duplicate descriptions of the same components are omitted herein.

In addition, it will be understood that when a component is referred to as being 'connected to' or 'coupled to' another component herein, it may be directly connected to or coupled to the other component, or one or more intervening components may be present. On the other hand, it will be understood that when a component is referred to as being 'directly connected to' or 'directly coupled to' another component herein, there are no other intervening components.

The terminology used in the detailed description is for the purpose of describing the embodiments of the present disclosure only and is not intended to be limiting of the present disclosure.

As used herein, the singular forms 'a' and 'an' are intended to include the plural forms as well, unless the context clearly indicates otherwise.

It should be understood that the terms 'comprises', 'comprising', 'includes', and 'including' when used herein, specify the presence of the features, numbers, steps, operations, components, parts, or combinations thereof described herein, but do not preclude the presence or addition of one or more other features, numbers, steps, operations, components, or combinations thereof.

In addition, in this specification, the term 'and/or' includes a combination of a plurality of listed items or any of the plurality of listed items. In the present specification, 'A or B' may include 'A', 'B', or 'both A and B'.

FIG. 1 shows an interior of a laundry treating apparatus 1 according to an embodiment of the present disclosure. The laundry treating apparatus 1 may include a cabinet 10, a tub 20, and a drum 30.

The cabinet 10 may be in any shape as long as being able to accommodate the tub 20, and FIG. 1 shows a case in which the cabinet 10 forms an appearance of the laundry treating apparatus 1 as an example.

The cabinet 10 may have a laundry inlet 12 defined therein for putting laundry into the drum 30 or withdrawing the laundry stored in the drum 30 to the outside, and may have a laundry door 13 for opening and closing the laundry inlet 12.

FIG. 1 shows that a laundry inlet 12 is defined in a top surface 11 of a cabinet 10, and a laundry door 13 for opening and closing the laundry inlet 12 is disposed on the top surface 11 according to an embodiment of the present disclosure. However, the laundry inlet 12 and the laundry door 13 are not necessarily limited to being defined in and disposed on the top surface 11 of the cabinet 10.

A tub 20 is means for storing water necessary for washing laundry. The tub 20 may have a tub opening 22 defined therein in communication with the laundry inlet 12. For example, one surface of the tub 20 may be opened to define the tub opening 22. At least a portion of the tub opening 22 may be positioned to face the laundry inlet 12, so that the tub opening 22 may be in communication with the laundry inlet 12.

FIG. 1 shows a top loading type laundry treating apparatus 1 according to an embodiment of the present disclosure. Therefore, FIG. 1 shows that a top surface of the tub 20 is opened to define the tub opening 22, and the tub opening 22 is positioned below the laundry inlet 12 and in communication with the laundry inlet 12.

The tub 20 is fixed at a location inside the cabinet 10 through a support of the tub 20. The support of the tub 20 may be in a structure capable of damping vibrations generated in the tub 20.

The tub 20 is supplied with water through a water supply 60. That is, the water supply 60 may be constructed to provide water to be supplied to the tub 20. The water supply 60 may be composed of a water supply pipe that connects a water supply source with the tub 20, and a water supply valve that opens and closes the water supply pipe.

The water supply 60 may be constructed to supply water to the tub 20 independently or through another component. For example, the water supply 60 may be connected to a detergent feeder 25 to be described later.

When the water supply 60 is connected with the detergent feeder 25, the water supply 60 may supply water to the detergent feeder 25, and the water supplied to the detergent feeder 25 may be delivered to the tub 20. That is, the water supply 60 may be constructed to supply the water to the tub 20 through the detergent feeder 25.

In addition, the water supply 60 may further include a water sprayer. The water sprayer may be constructed to directly spray the water supplied from the water supply pipe into the tub 20. That is, the water supply 60 may be constructed to supply the water into the tub 20 through the water sprayer.

In one example, the laundry treating apparatus 1 according to an embodiment of the present disclosure may include the detergent feeder 25 that may store detergent therein and may supply the detergent to the tub 20. As described above, the detergent feeder 25 may be connected to the water supply 60, and the water supplied from the water supply 60 may be supplied to the tub 20 through the detergent feeder 25.

The detergent feeder 25 may be formed in various shapes having a space in which the detergent is stored. FIG. 1 shows the detergent feeder 25 installed on the top surface 11 of the cabinet 10 according to an embodiment of the present disclosure, but the location of the detergent feeder 25 is not necessarily be limited to the top surface 11 of the cabinet 10.

The water stored in the tub 20 is discharged to the outside of the cabinet 10 through a drain 65. The drain 65 may be composed of a drain pipe that guides the water inside the tub 20 to the outside of the cabinet 10, and a drain pump disposed on the drain pipe.

The drum 30 may be rotatably disposed inside the tub 20. The drum 30 may be constructed to have a circular cross-section in order to be rotatable inside the tub 20. For example, the drum 30 may be in a cylindrical shape as shown in FIG. 1.

The top surface 31 of the drum 30 may be opened to form an open surface. The open surface may be formed below the tub opening 22 to be in communication with the tub opening 22.

A plurality of through-holes that communicate an interior and an exterior of the drum 30 with each other, that is, the interior of the drum 30 and an interior of the tub 20 divided by the drum 30 with each other may be defined in an outer circumferential surface of the drum 30. Accordingly, the water supplied into the tub 20 may be supplied to the interior of the drum 30 in which the laundry is stored through the through-holes.

The drum 30 may be rotated by a driver 50. The driver 50 may be constructed to provide a rotational force to the drum 30. That is, the driver 50 may be constructed to rotate the drum 30.

The driver 50 may be composed of a stator fixed at a location outside the tub 20 and forming a rotating magnetic field when a current is supplied, a rotor rotated by the rotating magnetic field, and a rotation shaft 40 disposed to penetrate the tub 20 to connect the drum 30 and the like to the rotor.

As shown in FIG. 1, in one embodiment of the present disclosure, the rotation shaft 40 may be disposed to form a right angle with respect to a bottom surface of the tub 20. In this case, the laundry inlet 12 may be defined in the top surface 11 of the cabinet 10, the tub opening 22 may be defined in the top surface of the tub 20, and the drum opening may be defined in the top surface of the drum 30.

In one example, when the drum 30 rotates in a state in which the laundry is concentrated in a certain region inside the drum 30, that is, when a distribution degree or uniformity of distribution of the laundry inside the drum 30 is low, a dynamic unbalance state (an unbalanced state) occurs in the drum 30.

When the drum 30 in the unbalanced state rotates, the drum 30 rotates while vibrating by a centrifugal force acting on the laundry. The vibration of the drum 30 may be transmitted to the tub 20 or the cabinet 10 to cause a noise.

To avoid problems like this, the present disclosure may further include a balancer 39 that controls the unbalance of the drum 30 by generating a force to offset or damp the centrifugal force acting on the laundry.

In one example, one embodiment of the present disclosure may include a controller 70 that performs a washing process (P100) by controlling the water supply 60, the drain 65, the driver 50, and the like in the washing process (P100) of the laundry.

The washing process (P100) of the laundry may include at least one of a cleaning process (P10), a rinsing process (P20), and a dehydration process (P30). Whether to include the cleaning process (P10), the rinsing process (P20), and the dehydration process (P30) may be determined by the user.

For example, the user may select each process to be included in the washing process (P100) by manipulating a manipulation unit disposed on the cabinet 10 and exposed to the outside. Therefore, combinations of the processes performed in the washing process (P100) of the clothes may be various.

The cleaning process (P10) is a process of removing existing foreign matter from the clothes, that is, the laundry in a state in which detergent is supplied from the detergent feeder 25 into the tub 20 and water is supplied into the tub 20 through the water supply 60.

In the cleaning process (P10), a detergent supply process in which the detergent is supplied or a water supply process (P40) in which the water is supplied may be performed various number of times as needed, and may be performed at various time points as needed. The cleaning process (P10) may include a drainage process (P50) or a distribution determination process (P60) of determining uniformity of distribution of the laundry as needed.

The rinsing process (P20) is a process of discharging the foreign substances remaining in the laundry or separated from the laundry from the inside of the tub 20 in the state in which the water is supplied into the tub 20 through the water supply 60. The foreign substances may be discharged together with the water in the drainage process (P50) in which the water is discharged from the tub 20.

In the rinsing process (P20), the water supply process (P40) in which the water is supplied and the drainage process (P50) in which the water is discharged may be performed various number of times as needed, and may be performed at various time points as needed.

The dehydration process (P30) is a process of removing moisture from the laundry stored inside the drum 30. In the dehydration process (P30), the rotation of the drum 30 and/or the rotator 100 may be performed various number of times in various schemes as needed.

The controller 70 may be configured to control the water supply 60, the drain 65, the detergent feeder 25, the gear set 45, and the like in the washing process (P100). An amount of water supplied by the water supply 60 and an amount of detergent supplied by the detergent feeder 25 may be adjusted through the manipulation unit manipulated by the user, or may be determined through the amount of laundry, the load of the driver 50, and the like.

In one example, as shown in FIG. 1, in one embodiment of the present disclosure, the laundry treating apparatus 1 may further include the rotator 100. The rotator 100 may be rotatably installed on the bottom surface 33 and inside the drum 30.

In one embodiment of the present disclosure, the drum 30 and the rotator 100 may be constructed to be rotatable, independently. A water flow may be formed by the rotation of the drum 30 and the rotator 100, and friction or collision with the laundry may occur, so that washing or rinsing of the laundry may be made.

Figure 2:
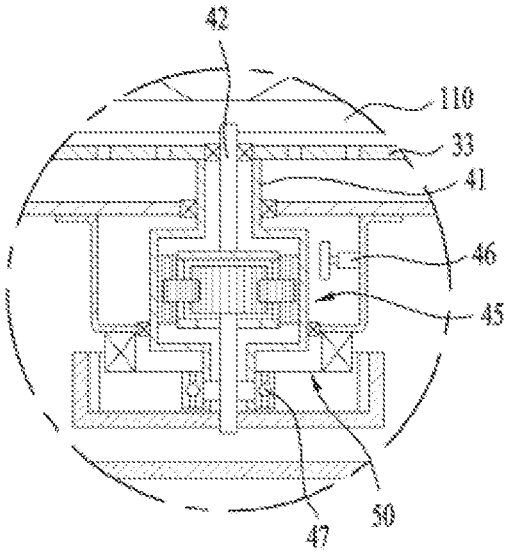
FIG. 2 is a view showing a rotation shaft and a gear set in a laundry treating apparatus according to an embodiment of the present disclosure.

In one example, FIG. 2 shows the rotation shaft 40 coupled with the drum 30 and the rotator 100 according to an embodiment of the present disclosure. Each of the drum 30 and the rotator 100 may be connected to the driver 50 through the rotation shaft 40 to receive a rotational force.

In one embodiment of the present disclosure, the rotation shaft 40 may include a first rotation shaft 41 and a second rotation shaft 42. The drum 30 may be rotated as a drum rotation shaft 41 is coupled to the bottom surface thereof, and the rotator 100 may be rotated by being coupled to a bottom rotation shaft 42 that passes through the bottom surface and separately rotated with respect to the drum rotation shaft 41.

The second rotation shaft 42 may rotate in a direction the same as or opposite to a rotation direction of the first rotation shaft 41. The first rotation shaft 41 and the second rotation shaft 42 may receive power through one driver 50, and the driver 50 may be connected to a gear set 45 that distributes the power to the first rotation shaft 41 and the second rotation shaft 42 and adjusts the rotation direction.

That is, a driving shaft of the driver 50 may be connected to the gear set 45 to transmit the power to the gear set 45, and each of the first rotation shaft 41 and the second rotation shaft 42 may be connected to the gear set 45 to receive the power.

The first rotation shaft 41 may be constructed as a hollow shaft, and the second rotation shaft 42 may be constructed as a solid shaft disposed inside the first rotation shaft 41. Accordingly, one embodiment of the present disclosure may effectively provide the power to the first rotation shaft 41 and the second rotation shaft 42 parallel to each other through the single driver 50.

FIG. 2 shows a planetary gear-type gear set 45, and shows a state in which each of the driving shaft, the first rotation shaft 41, and the second rotation shaft 42 is coupled to the gear set 45. Referring to FIG. 2, a rotational relationship of the first rotation shaft 41 and the second rotation shaft 42 in one embodiment of the present disclosure will be described as follows.

The driving shaft of the driver 50 may be connected to a central sun gear in the planetary gear-type gear set 45. When the driving shaft is rotated, a satellite gear and a ring gear in the gear set 45 may rotate together by the rotation of the sun gear.

The first rotation shaft 41 coupled to the bottom surface of the drum 30 may be connected to the ring gear positioned at the outermost portion of the gear set 45. The second rotation shaft 42 coupled to the rotator 100 may be connected to the satellite gear disposed between the sun gear and the ring gear in the gear set 45.

In one example, the gear set 45 may include a clutch element 46 that may restrict the rotation of each of the rotation shafts 40 as needed. The clutch element 46 may include a first clutch element 47 and a second clutch element 48.

The gear set 45 may further include a gear housing fixed to the tub 20, and the first clutch element 47 may be disposed in the gear housing to selectively restrict the rotation of the first rotation shaft 41 connected to the ring gear.

The second clutch element 48 may be constructed to mutually restrict or release the rotations of the driving shaft and the ring gear. That is, the rotation of the ring gear or the rotation of the first rotation shaft 41 may be synchronized with or desynchronized with the driving shaft by the second clutch element 48.

In one embodiment of the present disclosure, when the first clutch element 47 and the second clutch element 48 are in the releasing state, the first rotation shaft 41 and the second rotation shaft 42 rotate in the opposite directions based on the rotational relationship of the planetary gear. That is, the drum 30 and the rotator 100 rotate in the opposite directions.

In one example, when the first clutch element 47 is in the restricting state, the rotations of the ring gear and the first rotation shaft 41 are restricted, and the rotation of the second rotation shaft 42 is performed. That is, the drum 30 is in a stationary state and only the rotator 100 rotates. In this connection, the rotation direction of the rotator 100 may be determined based on the rotation direction of the driver 50.

In one example, when the second clutch element 48 is in the restricting state, the rotations of the driving shaft and the first rotation shaft 41 are mutually restricted to each other, and the rotations of the driving shaft, the first rotation shaft 41, and the second rotation shaft 42 may be mutually restricted to each other by the rotational relationship of the planetary gear. That is, the drum 30 and the rotator 100 rotate in the same direction.

When the first clutch element 47 and the second clutch element 48 are in the restricting state at the same time, the driving shaft, the first rotation shaft 41, and the second rotation shaft 42 are all in the stationary state. The controller 70 may implement a necessary driving state by appropriately controlling the driver 50, the first clutch element 47, the second clutch element 48, and the like in the washing process, the rinsing process P20, and the like.

Figure 3:
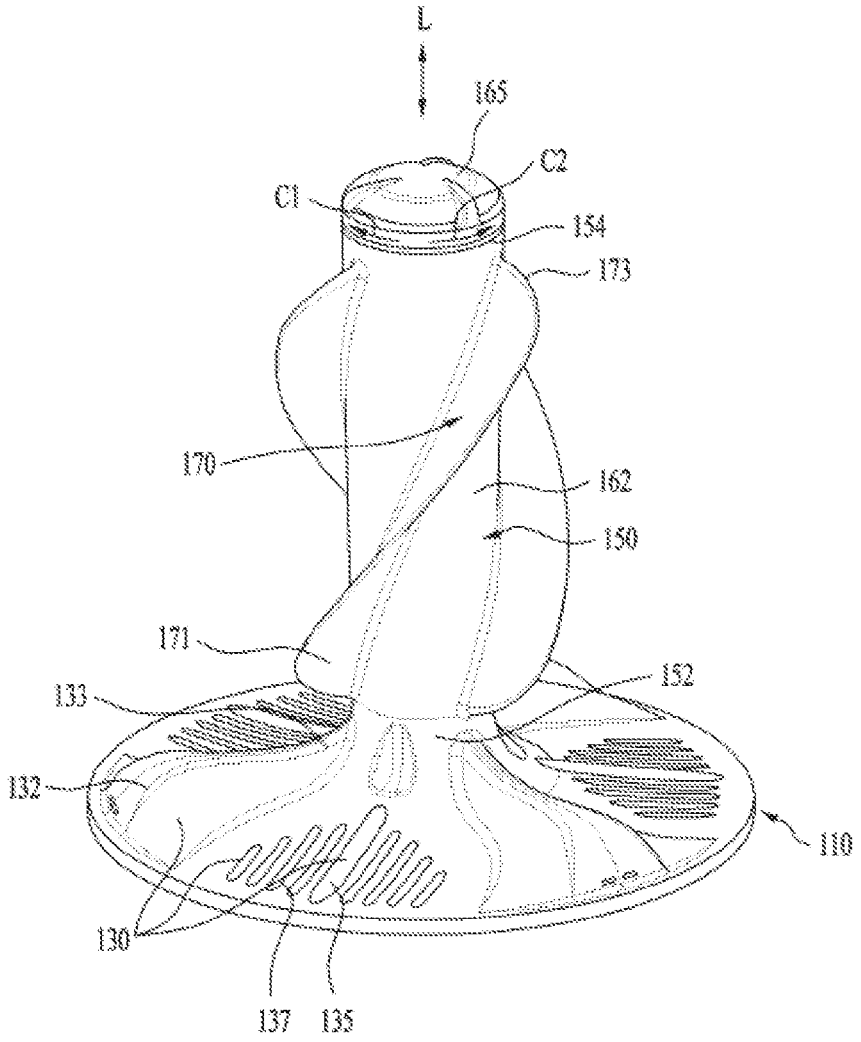
FIG. 3 is a perspective view of a rotator of a laundry treating apparatus according to an embodiment of the present disclosure.

In one example, FIG. 3 is a perspective view of the rotator 100 according to an embodiment of the present disclosure. In one embodiment of the present disclosure, the rotator 100 may include a bottom portion 110, a pillar 150, and a blade 170.

The bottom portion 110 may be located on the bottom surface 33 of the drum 30. The bottom portion 110 may be positioned parallel to the bottom surface 33 of the drum 30 to be rotatable on the bottom surface 33. The bottom rotation shaft 42 described above may be coupled to the bottom portion 110.

That is, the drum rotation shaft 41 may be coupled to the drum 30, and the bottom rotation shaft 42 constructed as the solid shaft inside the hollow drum rotation shaft 41 may penetrate the bottom surface 33 of the drum 30 and be coupled to the bottom portion 110 of the rotator 100.

The rotator 100 coupled to the drum rotation shaft 42 may rotate independently with respect to the drum 30. That is, the rotator 100 may be rotated in the direction the same as or opposite to that of the drum 30, and such rotation direction may be selected by the controller 70 or the like when necessary.

The drum rotation shaft 41 may be coupled to a center of the bottom surface 33 of the drum 30. FIG. 1 shows that the top surface 31 of the drum 30 is opened to define the open surface according to an embodiment of the present disclosure, and the bottom surface thereof corresponds to the bottom surface 33.

That is, the laundry treating apparatus 1 shown in FIG. 1 corresponds to a top loader. The drum 30 may have a side surface, that is, an outer circumferential surface, that connects the top surface 31 with the bottom surface 33, and a cross-section of the drum 30 may have a circular shape for balancing the rotation. That is, the drum 30 may have a cylindrical shape.

The bottom rotation shaft 42 may be coupled to a center of the bottom portion 110 of the rotator 100. The bottom rotation shaft 42 may be coupled to one surface facing the drum 30, that is, a bottom surface of the bottom portion 110, or the bottom rotation shaft 42 may pass through a center of the drum 30 to be coupled to the bottom portion 110.

The bottom portion 110 may have a circular cross-section in consideration of balancing of the rotation. The bottom portion 110 may be rotated about the bottom rotation shaft 42 coupled to the center thereof, and the center of the bottom portion 110 may coincide with the center of the drum 30.

The bottom portion 110 may basically have a disk shape, and a specific shape thereof may be determined in consideration of a connection relationship between a protrusion 130, the pillar 150, and the like as will be described later.

The bottom portion 110 may cover at least a portion of the drum 30. The bottom portion 110 may be constructed such that the bottom surface thereof and the drum 30 are spaced apart from each other to facilitate the rotation. However, a spaced distance between the bottom portion 110 and the bottom surface 33 of the drum 30 may be varied as needed.

In one example, as shown in FIG. 3, the pillar 150 may have a shape protruding from the bottom portion 110 toward the open surface. That is, the pillar 150 may have a shape extending in the vertical direction. The pillar 150 may be integrally formed with the bottom portion 110 or manufactured separately and coupled to the bottom portion 110.

The pillar 150 may be rotated together with the bottom portion 110. The pillar 150 may extend from the center of the bottom portion 110 toward the open surface. FIG. 1 shows the pillar 150 protruding upwardly from the bottom portion 110 according to an embodiment of the present disclosure. The pillar 150 may have a circular cross-section, and a protruding height L1 from the bottom portion 110 may vary. An opening may be defined at the upper end 154 of the pillar 150, and a cap 165 that shields the opening may be disposed.

The pillar 150 may have a curved side surface forming an outer circumferential surface 162, the rotator 100 may include the blade 170, and the blade 170 may be disposed on the outer circumferential surface 162 of the pillar 150.

The blade 170 may be constructed to protrude from the pillar 150, and may extend along the pillar 150 to form the water flow inside the drum 30 when the pillar 150 rotates.

A plurality of blades 170 may be disposed and spaced apart from each other along a circumferential direction of the pillar 150, and may extend from the bottom portion 110 to the open surface 31 along a direction inclined with respect to a longitudinal direction L of the pillar 150.

Specifically, as shown in FIG. 3, the blade 170 may extend approximately along the longitudinal direction L of the pillar 150. The plurality of blades 170 may be disposed, and the number of blades may vary as needed. FIG. 3 shows a state in which three blades 170 are disposed on the outer circumferential surface of the pillar 150 according to an embodiment of the present disclosure.

The blades 170 may be uniformly disposed along the circumferential direction of the pillar 150. That is, spaced distances between the blades 170 may be the same. When viewed from the top, the blades 170 may be spaced apart from each other at an angle of 120 degrees with respect to a center of the pillar 150.

The blade 170 may extend along a direction inclined with respect to the longitudinal direction L or the circumferential direction of the pillar 150. The blade 170 may extend obliquely from the bottom portion 110 to the open surface 31 on the outer circumferential surface of the pillar 150. An extended length of the blade 170 may be varied as needed.

As the blade 170 extends obliquely, when the rotator 100 is rotated, an ascending or descending water flow may be formed in the water inside the drum 30 by the blade 170 of the pillar 150.

For example, in one embodiment of the present disclosure, the rotator 100 may rotate in one direction C1 and the other direction C2, and the blade 170 may extend from a lower end 171 to an upper end 173 while being inclined toward the other direction C2 with respect to the longitudinal direction L of the pillar 150.

Therefore, when the rotator 100 rotates in said one direction C1, the ascending water flow may be formed by the inclined shape of the blade 170. In addition, when the rotator 100 is rotated in the other direction C2, the descending water flow may be formed by the blade 170.

In one embodiment of the present disclosure, as the plurality of blades 170 are disposed and spaced apart from each other, the water flow may be uniformly formed by the pillar. When the rotator 100 is rotated by the inclined extension form of the blade 170, not a simple rotational water flow, but the ascending water flow in which water at a lower portion of the drum 30 flows upward or the descending water flow in which water at an upper portion of the drum 30 flows downward may occur.

One embodiment of the present disclosure may form a three-dimensional water flow through the rotator 100, and thus greatly improve a washing efficiency for the laundry in the washing process. In addition, various rotation motions of the rotator 100 may be implemented by appropriately utilizing the ascending water flow and the descending water flow.

The blade 170 according to an embodiment of the present disclosure may have a screw shape. That is, the plurality of blades 170 may be disposed and be spaced apart from each other along the circumferential direction of the pillar 150, and may extend in the form of the screw from one end 171 facing the bottom portion 110 to the other end 173 facing the open surface.

In other words, in one embodiment of the present disclosure, the plurality of blades 170 may extend while being wound on the outer circumferential surface of the pillar 150 from the lower end 152 facing the bottom portion 110 to the upper end 154 facing the open surface.

Figure 4:
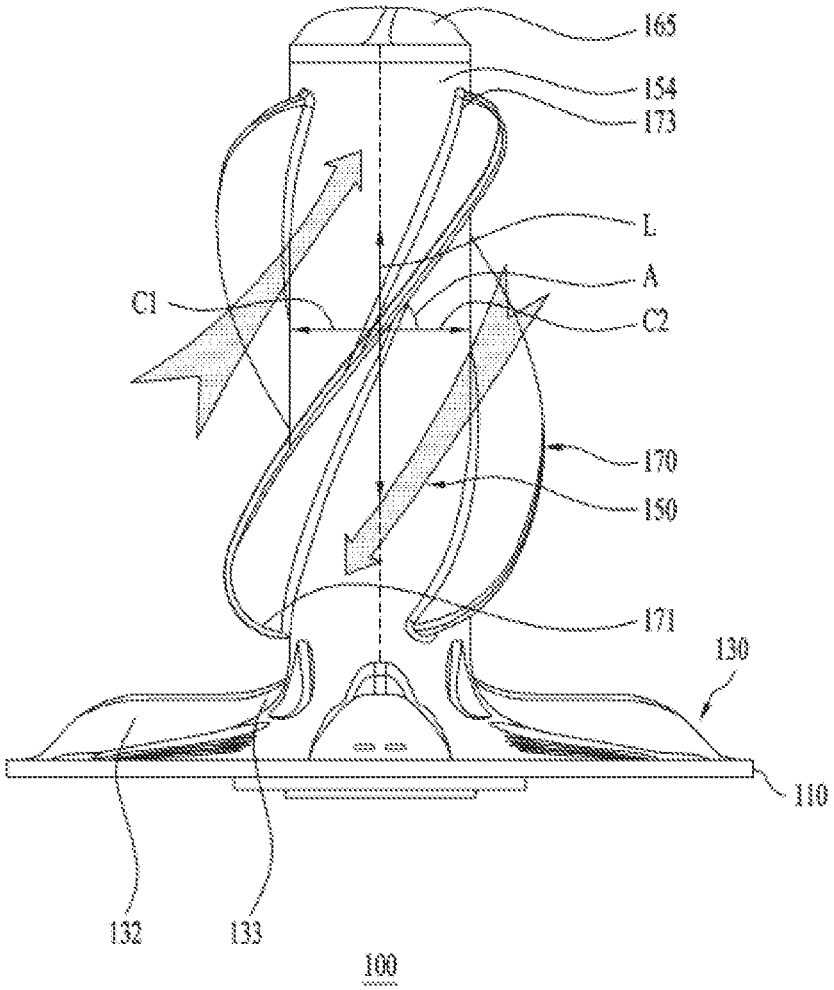
FIG. 4 is a side view of a rotator of a laundry treating apparatus according to an embodiment of the present disclosure.

In one example, FIG. 4 shows a side view of the rotator 100 according to an embodiment of the present disclosure. When referring to FIG. 4, in one embodiment of the present disclosure, the blade 170 may be inclined in the other direction C2 with respect to the longitudinal direction L of the pillar 150, and may extend from the lower end 171 to the upper end 173.

That is, the blade 170 may be constructed to extend while forming an inclination angle A with respect to the rotation direction of the bottom portion 110 or the rotator 100, and the upper end 173 of the blade 170 may be disposed at a position spaced apart from the lower end 171 of the blade 170 in the other direction C2.

When the inclination direction of the blade 170 is changed from the other direction C2 to said one direction C1 during the extension, during the rotation of the rotator 100, a portion of the blade 170 may generate the ascending water flow and the remaining portion may generate the descending water flow, so that it may be difficult to maximize the effect of either ascending or descending of the water.

Accordingly, in one embodiment of the present disclosure, the blade 170 may extend while only being inclined in the other direction C2 with respect to the longitudinal direction L of the pillar 150, the inclination angle A or the specific shape of the blade 170 may be variously determined. Said one direction C1 may be one of a clockwise direction and a counterclockwise direction, and the other direction C2 may be the other one.

In one example, in one embodiment of the present disclosure, the blade 170 may continuously extend from the lower end 171 to the upper end 173. The blade 170 may extend from said the lower end 171 to the upper end 173 to be continuously inclined with respect to the longitudinal direction L of the pillar 150. That is, the blade 170 may be formed in an inclined shape as a whole without a portion parallel to the longitudinal direction L of the pillar 150.

A length of the pillar 150 may be related to a washing performance and the load of the driver 50. For example, when the length of the pillar 150 is increased, the washing performance may be improved, but an excessive load may be applied to the driver 50. When the length of the pillar 150 is reduced, the load on the driver 50 may be reduced, but the washing performance may also be reduced.

Considering the above relationship, one embodiment of the present disclosure may determine a ratio between the length of the pillar 150 and a diameter of the bottom portion 110. When the length of the pillar 150 is too small, and when an amount of water supplied is large because of a large amount of laundry, because an area in which the water flow is formed by the pillar 150 and the blade 170 is reduced, the washing performance may be deteriorated.

When the length of the pillar 150 is too large, in the washing process, because a surplus length of the pillar 150 that is a length of a portion does not come into contact with the laundry and the water becomes excessive, it may lead to material loss and lead to an unnecessary load increase of the driver 50.

In addition, the bottom portion 110 contributes to the formation of the water flow as a protrusion 130 or the like is formed thereon as will be described below. Therefore, the relationship between lengths of the bottom portion 110 and the pillar 150 determines an effect of the water flow by the bottom portion 110 and an effect of the water flow by the pillar 150.

The protrusion 130 may include each main protrusion 132 having an inner end 133 connected to the pillar 150, and having a greatest height, each first sub-protrusion 135 disposed between a pair of main protrusions 132 and having a height smaller than that of the main protrusion 132, and a plurality of second sub-protrusion 137, each group of which is disposed between each first sub-protrusion 135 and each main protrusion 132, wherein the second sub-protrusion 137 has a height smaller than that of the first sub-protrusion 135.

The diameter of the bottom portion 110 may be variously determined in consideration of a diameter of the pillar 150, sizes of the tub 20 and the drum 30 of the laundry treating apparatus 1, a capacity of the laundry allowed in the laundry treating apparatus 1, an amount of water supplied resulted therefrom, and the like.

The length of the pillar 150 may be variously determined in consideration of a diameter of the drum 30 as well as a height of the drum 30, a diameter of the pillar 150, an inclination angle A of the blade 170, and the like.

Because the bottom portion 110 is positioned on the bottom surface of the drum 30 and rotated, the diameter of the bottom portion 110 with respect to the diameter of the drum 30 needs to be considered. When the diameter of the bottom portion 110 is too small, the effect of the water flow by the rotation of the bottom portion 110 may be too small. When the diameter of the bottom portion 110 is too large, it is easy to cause jamming of the laundry and is disadvantageous in the rotation by the load of the driver 50 and the like.

The diameter of the drum 30 may be variously determined in consideration of the capacity of the laundry allowed in the laundry treating apparatus 1, the amount of water supplied, and a relationship with the tub 20.

In one example, the height of the blade 170 may be determined in consideration of a relationship between an ascending amount and a descending amount of the water flow by the blade 170 and the load of the driver 50. The height of the blade 170 means a vertical distance from the lower end of the blade 170 to the upper end of the blade 170.

For example, as the height of the blade 170 becomes smaller, the area in which the blade 170 is formed may be reduced, and the ascending amount and the descending amount of the water flow may be reduced.

In addition, as the height of the blade 170 becomes greater, a water flow forming force by the blade 170 may become stronger, but the load of the driver 50 may be increased. In addition, the height of the blade 170 may be related to the inclination angle A of the blade 170, the diameter of the pillar 150, and the like.

The height of the blade 170 may be variously determined based on the size of the drum 30, the diameter of the bottom portion 110, the height of the pillar 150, the height of the protrusion 130, the position of the cap 165, and the like.

The length extending from the lower end 171 to the upper end 173 along the extension direction of the blade 170 may be defined as an extension length of the blade 170, and the height from the lower end 171 to the upper end 173 of the blade 170 may be defined as a height of the blade 170.

For example, when the number of turns that the blade 170 is wound on the pillar 150 at the same height of the blade 170 is increased, the extension length of the blade 170 is increased.

When the extension length of the blade 170 with respect to the height of the blade 170 becomes larger, a contact area between the blade 170 and the water may increase and the inclination angle A of the blade 170 may be decreased. Thus, a forming force of the ascending water flow or the descending water flow may be increased, but a forming force of the rotating water flow based on the rotation direction of the rotator 100 may be reduced.

On the other hand, when the extended length of the blade 170 is excessively reduced, the load on the driver 50 generated when the rotator 100 is rotated may increase and the forming force of the ascending water flow and the descending water flow may become too low, so that the washing efficiency may be reduced.

The extension length of the blade 170 may be variously determined based on the height of the blade 170, the diameter of the pillar 150, the inclination angle A of the blade 170, a load amount of the driver 50, a water flow formation level, and the like.

In one example, referring to FIG. 4, in one embodiment of the present disclosure, the blade 170 may extend such that the inclination angle A with respect to the circumferential direction of the pillar 150 is uniform. The blade 170 may be disposed on the outer circumferential surface of the pillar 150, extend from the lower end 171 facing toward the bottom portion 110 to the upper end 173 facing toward the top surface 31 of the drum 30, extend in the inclined form with respect to the longitudinal direction L or the circumferential direction of the pillar 150, and extend such that the inclination angle A with respect to the circumferential direction of the pillar 150 is constant.

When the inclination angle A of the blade 170 changes, the inclination angle A of the blade 170 is changed with respect to a vertical level of the pillar 150, so that levels of occurrence of the ascending water flow and the descending water flow may be different. In addition, in the process of forming the blade 170 on the outer circumferential surface of the pillar 150, the change in the inclination angle A of the blade 170 may be disadvantageous in manufacturing and may limit a manufacturing scheme.

For example, when the inclination angle A of the blade 170 is constant, constant ascending water flow and descending water flow formation may be expected over the entire length of the pillar 150, and a mold may be simply rotated and separated in a process of integrally molding the pillar 150 and the blade 170, which may be advantageous in the manufacturing.

In one example, as described above, the laundry treating apparatus 1 according to an embodiment of the present disclosure may include the tub 20, the drum 30, the water supply 60, the detergent feeder 25, the rotator 100, and the driver 50.

The tub 20 may include the space in which the water is stored defined therein, and the drum 30 may be disposed inside the tub 20, may have the open top surface 31 for inserting and withdrawing the clothes therethrough, and may be disposed to be rotatable inside the tub 20.

The water supply 60 may be constructed to provide the water to be supplied to the tub 20, and the detergent feeder 25 may be constructed to supply the detergent to be provided to the tub 20. The rotator 100 may be rotatably installed on the bottom surface 33 of the drum 30.

The driver 50 may be constructed to provide the rotational force to the rotator 100. In addition, the driver 50 may be constructed to provide the rotational force to each of the rotator 100 and the drum 30.

Referring to FIG. 2, as described above, the driver 50 may rotate the rotator 100 and/or the drum 30 through the rotation shaft 40. The rotation shaft 40 may include the first rotation shaft 41 and the second rotation shaft 42, the first rotation shaft 41 may be connected to the drum 30, and the second rotation shaft 42 may be connected to the rotator 100.

The gear set 45 may include the clutch element 46 connected to the driver 50, connected to the first rotation shaft 41 and the second rotation shaft 42 to transmit the power of the driver 50 to the first rotation shaft 41 and the second rotation shaft 42, and selectively constrain the first rotation shaft 41 to the second rotation shaft 42.

The controller 70 may control the rotation directions of the drum 30 and the rotator 100 by controlling the clutch element 46. For example, as described above, the controller 70 may control the second clutch element 48 of the clutch element 46 to synchronize the rotations of the first rotation shaft 41 and the second rotation shaft 42 with each other, or to desynchronize the rotations from each other. The controller 70 may control the driver 50 to determine a rotation motion of the rotator 100 and the drum 30.

In one example, the rotator 100 may include the bottom portion 110 located on the bottom surface 33 of the drum 30 and the pillar 150 protruding upward from the bottom portion 110 and having the blade 170 on the outer circumferential surface thereof.

Referring back to FIG. 4, the blade 170 may extend obliquely with respect to the longitudinal direction L of the pillar 150 to form the ascending water flow when the rotator 100 rotates in said one direction C1, and the descending water flow when the rotator 100 rotates in the other direction C2.

In one example, in one embodiment of the present disclosure, the rotator 100 may perform various rotation motions. The rotation motion may include a general motion and an ascending and descending motion. The ascending and descending motion may include an ascending motion M1 and a descending motion M2.

Figure 5:
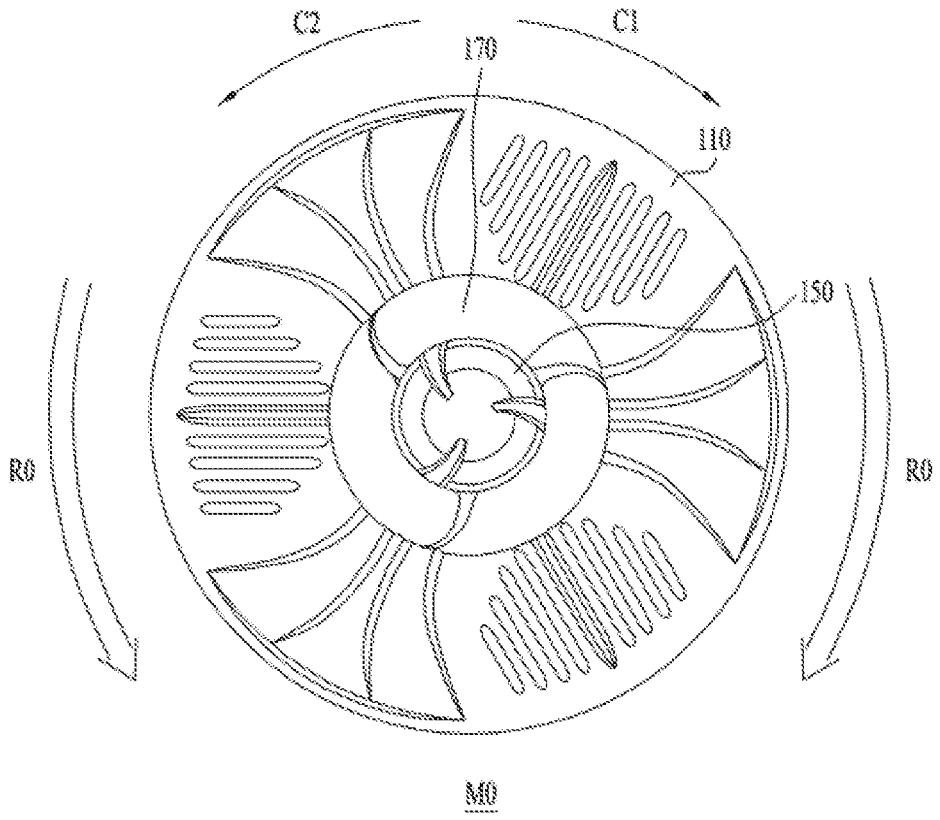
FIG. 5 is a view showing a general motion of a rotator in a laundry treating apparatus according to an embodiment of the present disclosure.

In FIG. 5, a general motion M0 of the rotator 100 according to an embodiment of the present disclosure is shown. The general motion M0 may include each of the rotation in said one direction C1 and the rotation in the other direction C2 of the rotator 100 at least once.

Referring to FIG. 5, in the rotation motion of the rotator 100 according to an embodiment of the present disclosure, each of the rotation in said one direction C1 and the rotation in the other direction C2 of the rotator 100 may be performed once in one cycle. However, the number of rotations in said one direction C1 and the number of rotations in the other direction C2 of the rotator 100 in one cycle of the rotation motion may be set to various numbers as needed, respectively.

In the general motion M0, the rotator 100 may have the same number of rotations in said one direction C1 and in the other direction C2, the rotation in said one direction C1 and the rotation in the other direction C2 may be alternately performed. That is, in the general motion M0, the rotator 100 may be rotated in said one direction C1 and then rotated in the other direction C2.

In the general motion M0, the rotator 100 may be rotated by a zeroth amount of rotation R0 in said one direction C1, and may be rotated by the zeroth amount of rotation R0 in the other direction C2. That is, the rotation in said one direction C1 and the rotation in the other direction C2 of the rotator 100 in the general motion M0 may be performed with the same amount of rotation.

Figure 6:
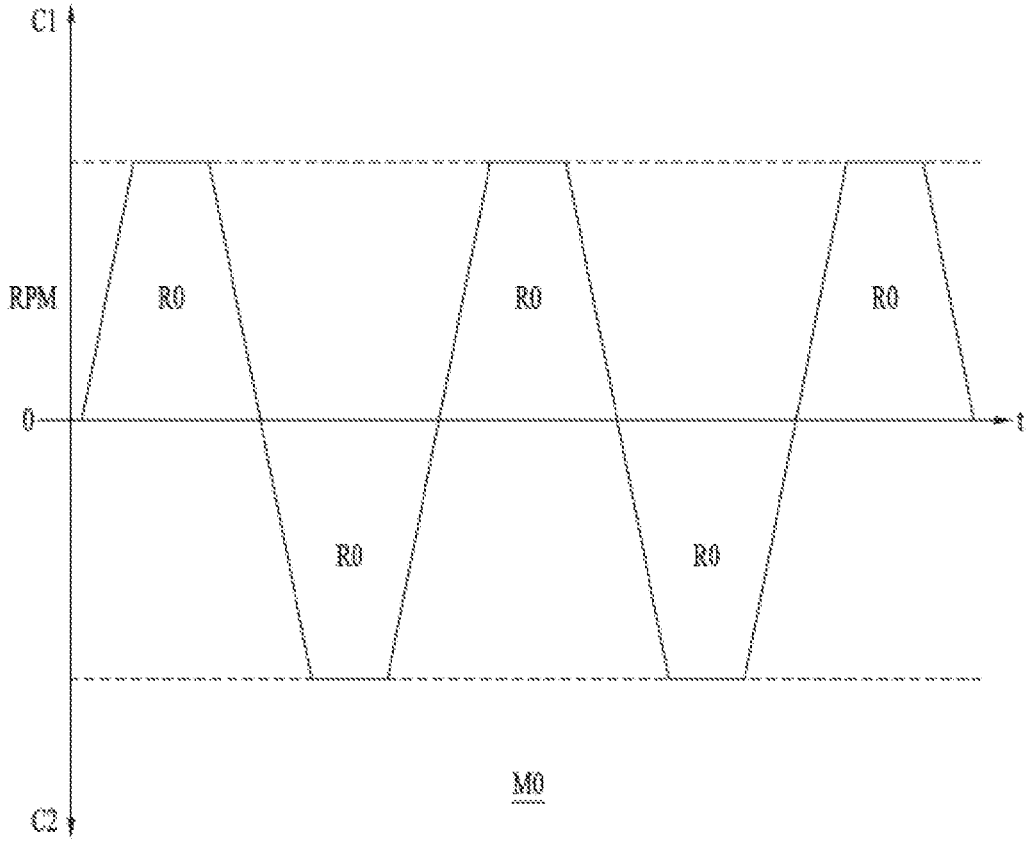
FIG. 6 is a graph showing an RPM of a rotator based on a general motion in a laundry treating apparatus according to an embodiment of the present disclosure.

FIG. 6 is a graph showing a change in an RPM of the rotator 100 over time in the general motion M0 of the rotator 100 according to an embodiment of the present disclosure. In the graph of FIG. 6, a horizontal axis represents a time, and a vertical axis represents the RPM of the rotator 100. In the vertical axis, a positive value means the rotation in said one direction C1 of the rotator 100, and a negative value means the rotation in the other direction C2 of the rotator 100.

Referring to FIG. 6, in the general motion M0, the rotator 100 may rotate in said one direction C1 by the zeroth amount of rotation R0 and then rotate in the other direction C2 by the zeroth amount of rotation R0. A maximum RPM and a rotation time of the rotation in said one direction C1 and the rotation in the other direction C2 may be the same.

In FIG. 6, the amount of rotation may be a relationship calculated by product of the rotation time and the RPM of the rotator 100. That is, each area defined by the RPM of the rotator 100 and the horizontal axis in FIG. 6 may correspond to the zeroth amount of rotation R0.

In general motion M0, the rotator 100 is rotated by the same amount of rotation in said one direction C1 and in the other direction C2. In one cycle of the general motion M0, the ascending water flow and the descending water flow by the rotator 100 are formed to have the same magnitude as each other and have a mutually offsetting relationship, so that laundry and water do not ascend or descend in an entirety of the general motion M0, and washing through the rotating water flow may be performed.

Figure 7:
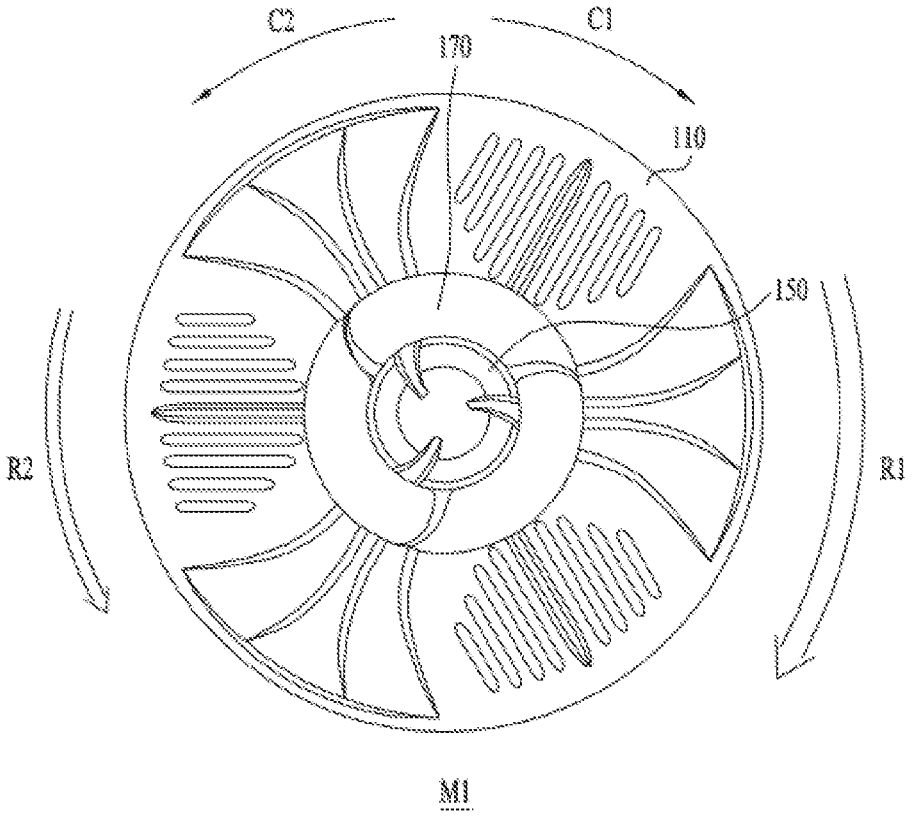
FIG. 7 is a view showing an ascending motion of a rotator in a laundry treating apparatus according to an embodiment of the present disclosure.
Figure 8:
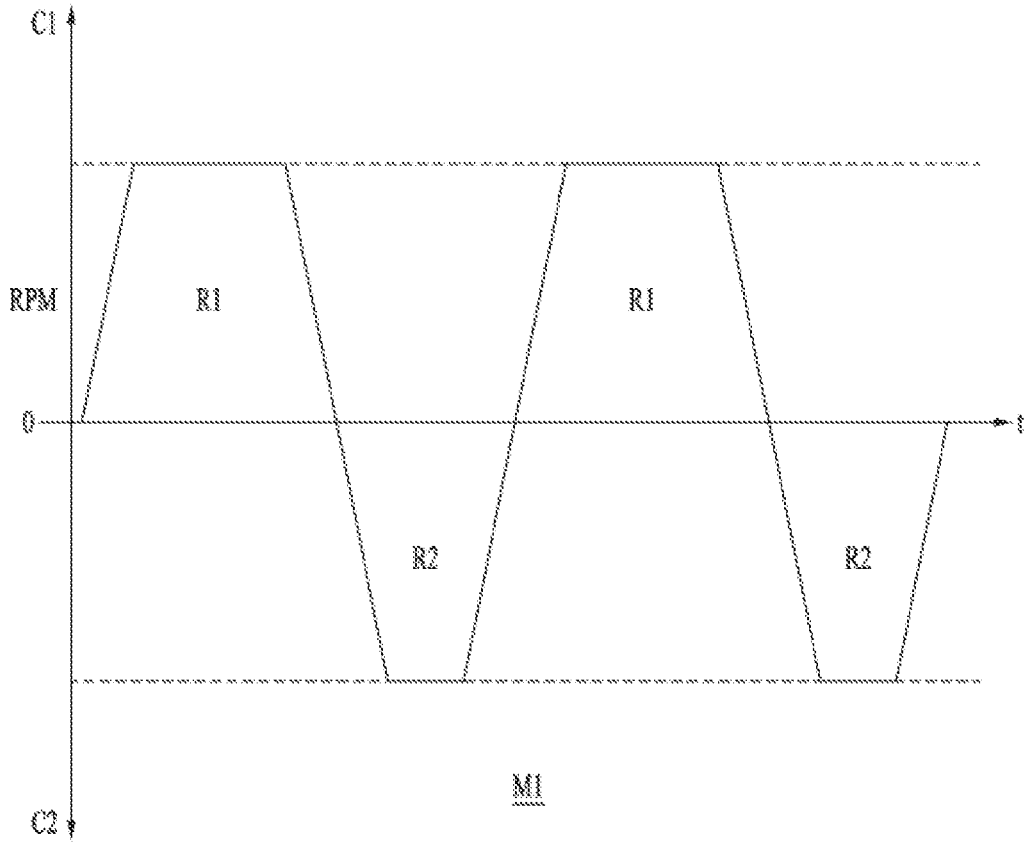
FIG. 8 is a graph showing an RPM of a rotator based on an ascending motion in a laundry treating apparatus according to an embodiment of the present disclosure.

FIG. 7 is a view showing the ascending motion M1 of the rotator 100 according to an embodiment of the present disclosure. FIG. 8 is a graph showing a change in the RPM of the rotator 100 based on the ascending motion M1.

Figure 9:
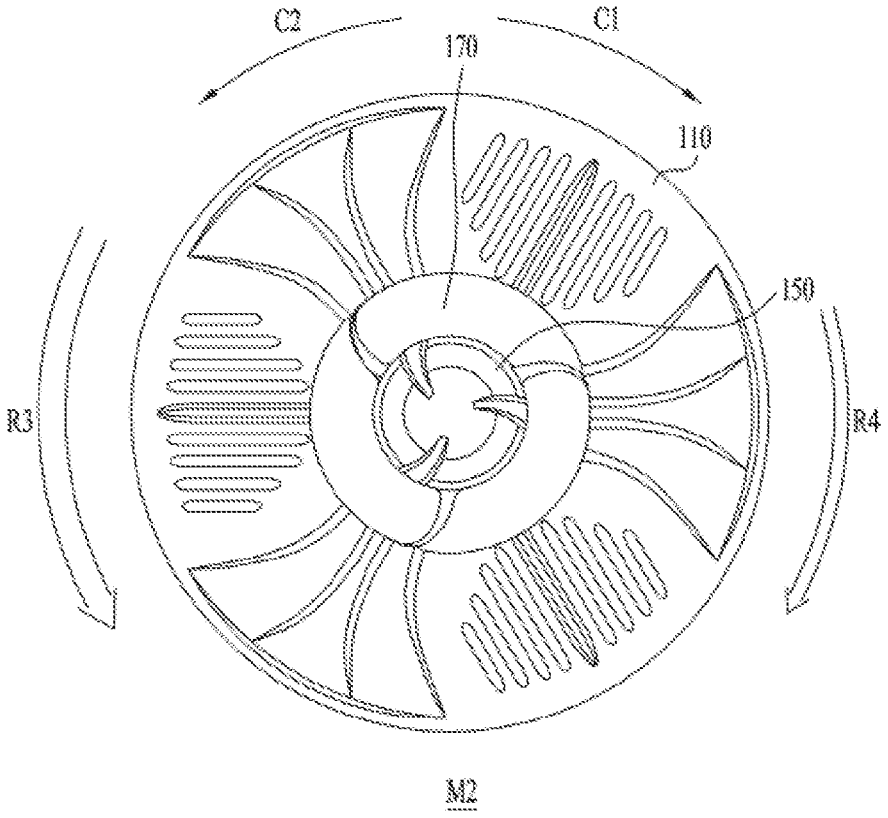
FIG. 9 is a view showing a descending motion of a rotator in a laundry treating apparatus according to an embodiment of the present disclosure.
Figure 10:
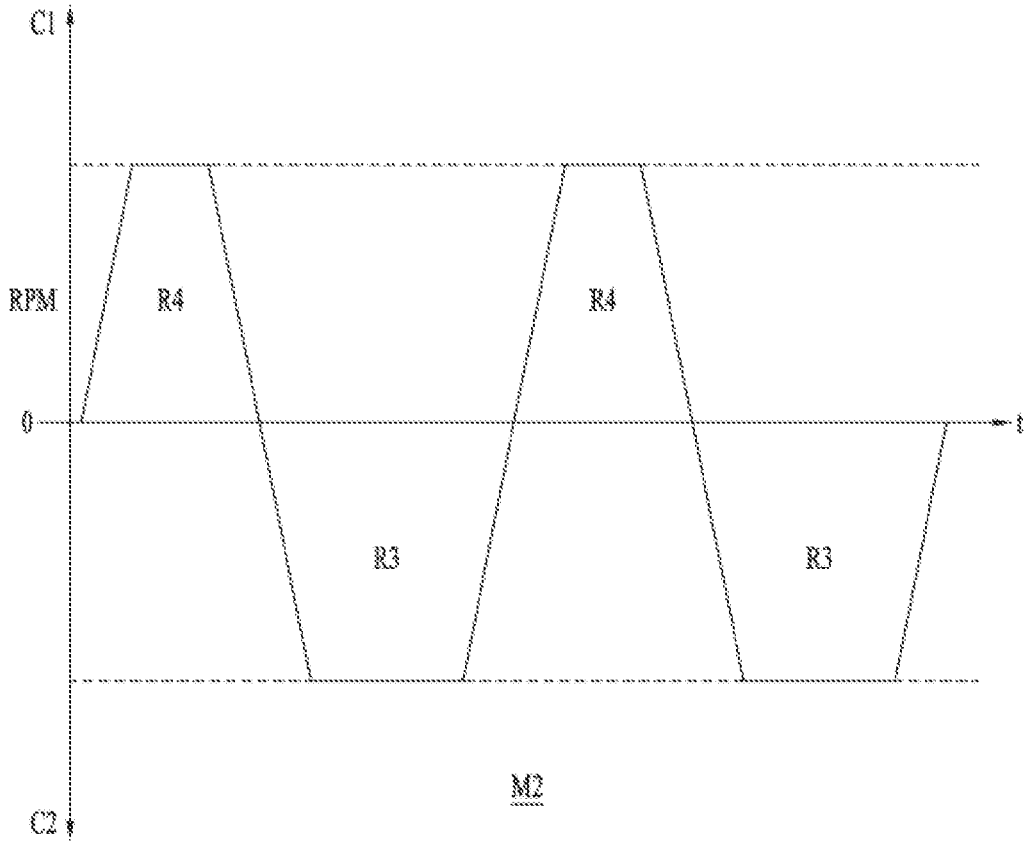
FIG. 10 is a graph showing an RPM of a rotator based on a descending motion in a laundry treating apparatus according to an embodiment of the present disclosure.

FIG. 9 is a view showing the descending motion M2 of the rotator 100 according to an embodiment of the present disclosure. FIG. 10 is a graph showing a change in the RPM of the rotator 100 based on the descending motion M2.

Referring to FIGS. 7 and 9, the controller 70 may control the driver 50 such that the rotator 100 performs the ascending and descending motion for forming the ascending water flow or the descending water flow at least once in the washing cycle (P100) of the laundry.

Specifically, in one embodiment of the present disclosure, the ascending and descending motion may form the ascending water flow or the descending water flow as a result of one cycle. As the blade 170 is extended while being inclined in the other direction C2 as described above, the ascending water flow may be formed in the water inside the tub 20 when the rotator 100 rotates in said one direction C1, and the descending water flow may be formed when the rotator 100 rotates in the other direction C2.

In one embodiment of the present disclosure, various rotation motions of the rotator 100 may be performed, and the rotation motion of the rotator 100 may be implemented as the controller 70 controls the driver 50. In one embodiment of the present disclosure, each rotation motion may include a plurality of rotations with different rotation directions in one motion cycle. The various rotation motions may be preset in the controller 70, and the controller 70 may control the driver 50 based on the set rotation motion.

The controller 70 may control the driver 50 such that the rotation in said one direction C1 and the rotation in the other direction C2 of the rotator 100 are performed with different amounts of rotation in the ascending and descending motion.

That is, in one embodiment of the present disclosure, the ascending and descending motion may be composed of one cycle by including the rotation in said one direction C1 of the rotator 100 together with the rotation in the other direction C2. The number of executions of the rotation in said one direction C1, the number of executions of the rotation in the other direction C2, and the amount of rotation may be variously determined.

In one example, in one embodiment of the present disclosure, the ascending and descending motion may ultimately implement the water flow characteristics required in the ascending and descending motion through a difference in the amount of rotation between the rotation in said one direction C1 and the rotation in the other direction C2 of the rotator 100.

For example, through the control of the driver 50 by the controller 70 in the ascending motion M1 of the ascending and descending motion, the rotator 100 may be rotated such that the amount of rotation in said one direction C1 is greater than the amount of rotation in the other direction C2.

The rotator 100 forms the ascending water flow when rotating in said one direction C1 and forms the descending water flow when rotating in the other direction C2. The rotator 100 eventually rotates in the ascending motion M1 such that the amount of rotation in said one direction C1 is greater than the amount of rotation in the other direction C2, so that, when the ascending motion M1 of the rotator 100 is performed, eventually the ascending water flow may be formed.

In addition, through the control of the driver 50 by the controller 70 in the descending motion M2 of the ascending and descending motion, the rotator 100 may rotate such that the amount of rotation in the other direction C2 is greater than the amount of rotation in said one direction C1.

The rotator 100 rotates in the descending motion M2 such that the amount of rotation in the other direction C2 is greater than the amount of rotation in said one direction C1, so that it may be understood that the descending water flow has ultimately formed when the descending motion M2 of the rotator 100 is performed.

In one embodiment of the present disclosure, because the rotation in said one direction C1 and the rotation in the other direction C2 are performed together in one cycle of the ascending and descending motion, a curling phenomenon in which the laundry is wound on the pillar 150 may be minimized.

For example, when the rotator 100 rotates only in either of said one direction C1 or the other direction C2 in the ascending and descending motion, the ascending water flow or the descending water flow may be formed, but the laundry around the pillar 150 may be wound by the rotation of the rotator 100, so that the load of the driver 50 may be increased, and the washing efficiency may be reduced as the flow of the laundry is lowered, and subsequent rotation of the pillar 150 may be restricted.

Therefore, in one embodiment of the present disclosure, as the rotation in said one direction C1 and the rotation in the other direction C2 are performed together in the ascending and descending motion for forming the ascending water flow or the descending water flow, the curling of the laundry may be minimized, and through the deviation of the amount of rotation between the rotation in said one direction C1 and the rotation in the other direction C2, the water flow may be efficiently formed in the corresponding motion, thereby improving the washing efficiency.

In the ascending and descending motion, the number of executions of the rotation in said one direction C1 and the number of executions of the rotation in the other direction C2 may be variously determined, and the order of the rotations may also be variously determined. Each amount of rotation of the rotation in said one direction C1 and the rotation in the other direction C2 may also be variously determined as needed.

In the present disclosure, the amount of rotation of the rotator 100 may be understood as a rotation angle. For example, in the ascending and descending motion, the rotator 100 may be rotated by a first rotation angle in said one direction C1 and rotated by a second rotation angle in the other direction C2.

The driver 50 may rotate the rotator 100 such that the rotator 100 performs the ascending and descending motion for forming the ascending water flow or the descending water flow at least once. In the ascending and descending motion, the driver 50 may rotate the rotator 100 such that the rotator 100 rotates by different amounts of rotation along said one direction C1 and the other direction C2.

Because the rotation of the rotator 100 is made by the driver 50 and the driver 50 is driven by the control to the controller 70, the rotation of the rotator 100 may eventually be controlled by the controller 70.

The controller 70 may control the rotation of the driving shaft of the driver 50 by adjusting a current or a voltage provided to the driver 50, and there may be various methods for the controller 70 to control the rotation of the driver 50. The driver 50 may be constructed such that a rotation angle thereof or the like is adjustable, like as a step motor or the like.

In one example, as described above, in one embodiment of the present disclosure, the plurality of blades 170 may be disposed to be spaced apart from each other along the circumferential direction of the pillar 150, may be inclined in the other direction C2 with respect to the longitudinal direction L of the pillar 150, and may extend from the lower end 152 toward the upper end 154 of the pillar 150.

Accordingly, as shown in FIG. 7, when the rotator 100 is rotated in said one direction C1, the ascending water flow may be formed by the blade 170. As shown in FIG. 9, when the rotator 100 is rotated in the other direction C2, the descending water flow may be formed.

Referring to FIG. 7 again, in one embodiment of the present disclosure, the ascending and descending motion may include the ascending motion M1 for forming the ascending water flow. The controller 70 may control the driver 50 such that, in the ascending motion M1, the rotator 100 rotates in said one direction C1 by the first amount of rotation R1, and rotates in the other direction C2 by the second amount of rotation R2 smaller than the first amount of rotation R1.

As described above, in one embodiment of the present disclosure, the ascending and descending motion among the rotation motions may include the ascending motion M1 and the descending motion M2. The ascending motion M1 may ultimately form the ascending water flow through the complex rotation of the rotator 100.

In the ascending motion M1, the rotator 100 may be rotated in said one direction C1 by the first amount of rotation R1, and rotated in the other direction C2 by the second amount of rotation R2. The second amount of rotation R2 may correspond to an amount of rotation smaller than the first amount of rotation R1.

FIG. 7 conceptually shows the first amount of rotation R1 and the second amount of rotation R2 by arrows. In the ascending motion M1, the rotator 100 rotates such that the first amount of rotation R1 is greater than the second amount of rotation R2, so that the ultimate water flow resulted from the ascending motion M1 may be understood as the ascending water flow.

As described above, in one embodiment of the present disclosure, the driver 50 may be constructed to rotate the rotator 100 as above, and the operation of the driver 50 may be controlled by the controller 70.

FIG. 8 is a graph showing the change in the RPM of the rotator 100 based on the ascending motion M1. A horizontal axis represents a time, and a vertical axis represents the RPM of the rotator 100. In the vertical axis, a positive value means the rotation in said one direction C1 of the rotator 100, and a negative value means the rotation in the other direction C2 of the rotator 100.

Referring to FIG. 8, in the ascending motion M1, the rotator 100 may rotate in said one direction C1 by the first amount of rotation R1 and then rotate in the other direction C2 by the second amount of rotation R2. An order of the rotation in said one direction C1 and the rotation in the other direction C2 may be changed as needed.

The amount of rotation of the rotator 100 may be a relationship calculated by product of the RPM and the time. That is, in FIG. 8, the amount of rotation of the rotator 100 may correspond to each area defined by being distinguished from each other by a line of the RPM and the horizontal axis. In the ascending motion M1, in the rotator 100, the rotation in said one direction C1 and the rotation in the other direction C2 may have the same maximum RPM, and may have different rotation times.

However, the maximum RPMs of the rotation in said one direction C1 and the rotation in the other direction C2 may be set differently from each other as needed, and the rotation times thereof may also be variously set as needed.

In the ascending motion M1, the rotator 100 may continuously rotate in the other direction C2 after rotating in said one direction C1, or may rotate in the other direction C2 after a stationary state where the RPM corresponds to 0 after the rotation in said one direction C1. A time required for the stationary state may vary as need.

In one example, in one embodiment of the present disclosure, the controller 70 may control the driver 50 such that the rotator 100 rotates in the other direction C2 after rotating in said one direction C1 in the ascending motion M1.

In the ascending motion M1, the first amount of rotation R1 is greater than the second amount of rotation R2. Thus, when the rotation in said one direction C1 is performed after the rotation in the other direction C2, because one cycle of the ascending motion M1 is terminated in a state in which the rotator 100 rotated with the relatively large first amount of rotation R1, the ascending motion M1 may be terminated in a state in which the laundry is curled in the rotation based on the first amount of rotation R1.

The first amount of rotation R1 may have a higher value than the second amount of rotation R2. For example, the first amount of rotation R1 may correspond to a rotation angle of 720 degrees of the rotator 100, and the second amount of rotation R2 may correspond to a rotation angle of 360 degrees of the rotator 100. The first amount of rotation R1 may be equal to or greater than 120% and equal to or smaller than 150% or may be equal to or greater than 150% and equal to or smaller than 200% of the second amount of rotation R2.

However, the rotation angles and a ratio relationship of the first amount of rotation R1 and the second amount of rotation R2 are only presented as an example for convenience of description, and do not limit the present disclosure. The rotation angles and the ratio relationship of the first amount of rotation R1 and the second amount of rotation R2 may be variously set as needed.

One embodiment of the present disclosure allows the rotation in said one direction C1 with the larger amount of rotation to be performed prior to the rotation in the other direction C2 in the ascending motion M1, thereby resolving the curling phenomenon of the laundry that may occur in the rotation in said one direction C1 through the rotation in the other direction C2.

In one embodiment of the present disclosure, the rotation in the other direction C2 with the larger amount of rotation is also performed prior to the rotation in said one direction C1 in the descending motion M2, thereby resolving the curling phenomenon of the laundry.

Figure 17:
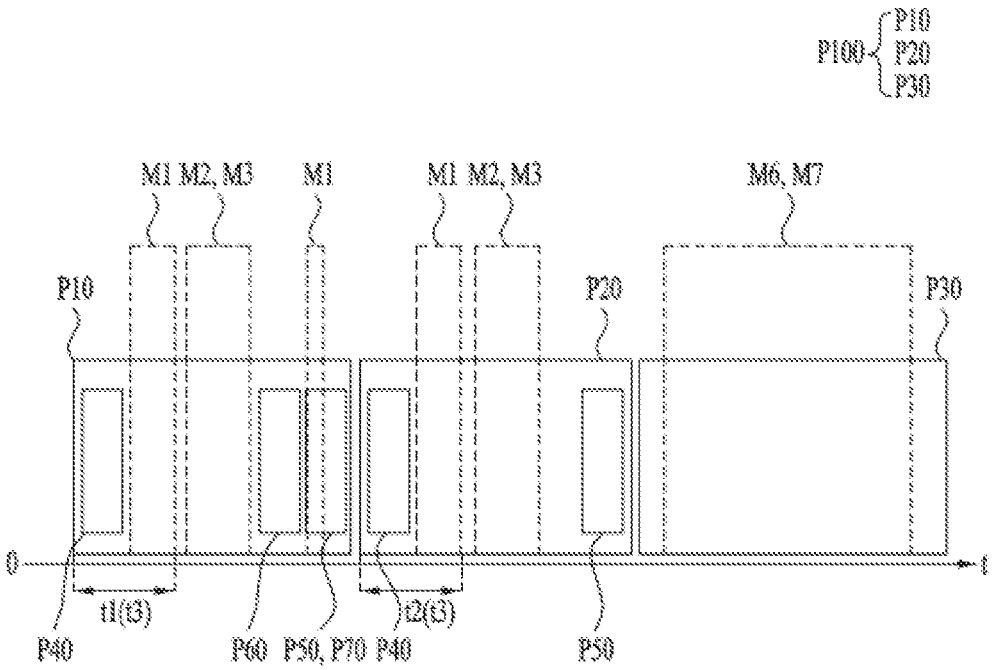
FIG. 17 is a view showing a washing cycle of laundry in a laundry treating apparatus according to an embodiment of the present disclosure.

In one example, FIG. 17 is a conceptual operation flowchart of the washing cycle (P100) of the laundry by the laundry treating apparatus 1 according to an embodiment of the present laundry disclosure. In FIG. 17, a horizontal axis is an axis of a time t.

FIG. 17 shows the cleaning process (P10), the rinsing process (P20), and the dehydration process (P30), and shows the water supply process (P40) or the like that may be performed in each process. A section in which one of the plurality of rotation motions may be performed is indicated by a dotted line area. However, in one embodiment of the present disclosure, the washing cycle (P100) is not necessarily limited to the content shown in FIG. 17.

In one embodiment of the present disclosure, as described above, the washing cycle (P100) may include at least one of the cleaning process (P10), the rinsing process (P20), and the dehydration process (P30), and the number of executions of each process or an execution order of the processes may vary.

Referring to FIG. 17, in one embodiment of the present disclosure, the washing cycle (P100) may include the cleaning process (P10) in which the detergent is supplied from the detergent feeder 25 into the tub 20 and the foreign substances are removed from the laundry.

The controller 70 may control the driver 50 such that the rotator 100 performs the ascending motion M1 at least once within a first reference time t1 after the start of the cleaning process (P10). In FIG. 10, a section in which the ascending motion M1 is performed within the first reference time t1 after the start of the cleaning process P10 according to an embodiment of the present disclosure is shown as a dotted line area.

The ascending motion M1 may form the ascending water flow, and may induce an upward movement of laundry positioned at a lower portion of the drum 30 of the laundry. That is, by performing the ascending motion M1, a vertical flow of the laundry may be generated.

After the start of the cleaning process (P10), the water and the detergent may be supplied into the tub 20 or the drum 30. At the beginning of the cleaning process (P10), the detergent needs to be mixed with the water and the laundry.

The ascending motion M1 may be accompanied by the ascending water flow from the lower portion to an upper portion of the drum 30 as well as the formation of the rotating water flow in the circumferential direction of the pillar 150. At the beginning of the cleaning process (P10), rapid dissolution of detergent may be required, and moisture content and detergent response throughout the laundry may be required.

Therefore, one embodiment of the present disclosure allows the ascending motion M1 to be performed at least once within the first reference time t1 after the start of the cleaning process (P10), so that rapid dissolution of the detergent may be induced and a moisture content and a detergent response of the entire laundry may be increased.

The first reference time t1 may be a time preset in the controller 70, and may be a time from the start of the cleaning process (P10) to a time point at which the ascending motion M1 is terminated after being repeatedly performed by the controller 70 at the beginning of the cleaning process (P10). FIG. 10 shows the first reference time t1 conceptually.

In one example, the washing cycle (P100) may further include the rinsing process (P20) in which the water is supplied from the water supply 60 to the tub 20 and the foreign substances are discharged from the tub 20 after the cleaning process (P10).

FIG. 17 shows the rinsing process (P20) performed after the cleaning process (P10) conceptually. However, the number of executions or an order of the rinsing process (P20) is not necessarily limited thereto.

The controller 70 may control the driver 50 such that the rotator 100 performs the ascending motion M1 at least once within a second reference time t2 after the start of the rinsing process (P20). FIG. 10 shows a section in which the ascending motion M1 is performed within the second reference time t2 in the rinsing process (P20).

At the beginning of the rinsing process (P20), the water supply process (P40) in which the water is supplied into the drum 30 may be performed. In the laundry, the foreign substances may remain after the cleaning process (P10). Therefore, it may be advantageous for a rinsing efficiency to flow the laundry through the formation of the three-dimensional water flow and to allow the water flow to pass through the laundry.

Therefore, in one embodiment of the present disclosure, the controller 70 may control the driver 50 such that the rotator 100 performs the ascending motion M1 at least once within the second reference time t2 after the start of the rinsing process P20.

The second reference time t2 may be a time preset in the controller 70, and may be a time from the start of the rinsing process (P20) to a time point at which the ascending motion M1 is terminated after being repeatedly performed by the controller 70 at the beginning of the rinsing process (P20). FIG. 10 shows the second reference time t2 conceptually.

In one example, the washing cycle (P100) may include the water supply process (P40) in which the water is supplied into the tub 20 through the water supply 60 at least once. The controller 70 may control the driver 50 such that the rotator 100 performs the ascending motion M1 within a third reference time t3 after the water supply process P40 is terminated.

The water supply process (P40) may be included in at least one of the cleaning process (P10), the rinsing process (P20), and the dehydration process (P30), or may be performed independently. FIG. 10 shows a state in which the water supply process (P40) is performed in each of the cleaning process (P10) and the rinsing process (P20).

In FIG. 17, it is shown that the water supply process (P40) is performed once in each of the cleaning process (P10) and the rinsing process (P20), but this is only for convenience of description, and the present disclosure is not necessarily limited as shown in FIG. 10. The number of executions or an execution time of the water supply process P40 may be variously set as needed.

In the water supply process (P40), the water supplied from the water supply 60 may be provided into the tub 20. When the water is introduced into the tub 20 through the cleaning process (P10) as well as the rinsing process (P20) and the water supply process (P40), an active mixing process between the laundry and the water put into the tub 20 through the formation of the three-dimensional water flow using the rotator 100 may improve the washing efficiency.

Therefore, in one embodiment of the present disclosure, the controller 70 may control the driver 50 such that the ascending motion M1 is performed within the third reference time t3 after the termination of the water supply process (P40). The number of executions of the ascending motion M1 may be variously determined as needed.

The third reference time t3 may be a time preset in the controller 70, and may be a time from the start of the water supply process (P40) to a time point at which the ascending motion M1 is terminated after being repeatedly performed by the controller 70. The third reference time t3 may be set to be the same as or different from the first reference time t1 and the second reference time t2.

In one example, in one embodiment of the present disclosure, the washing cycle P100 may include the distribution determination process (P60) in which the controller 70 determines the uniformity of distribution of the laundry inside the drum 30 at least once.

As described above, when the drum 30 is rotated in a state in which the laundry inside the drum 30 is concentrated in a certain region, vibration and noise resulted from unbalance may be generated. The uniformity of distribution of the laundry may mean a degree at which the laundry is uniformly distributed within the drum 30.

In one embodiment of the present disclosure, the rotator 100 may include the pillar 150, and the uniformity of distribution of the laundry of the drum 30 may be lowered by the pillar 150. Therefore, in one embodiment of the present disclosure in which the rotator 100 including the pillar 150 is disposed, it may be important to identify the uniformity of distribution of laundry and deal with it appropriately.

The uniformity of distribution of laundry may be determined in various schemes. For example, the driver 50 may be provided as a motor rotated through electric power or the like, and the controller 70 may control the driver 50 by controlling a current value or a voltage value provided to the driver 50. In consideration of a deviation of a rotation angle, a rotation speed, or a torque actually implemented on the driver 50 with respect to a target rotation angle, rotation speed, or torque of the driver 50 input by the controller 70, the uniformity of distribution may be determined.

For example, when the driver 50 rotates the drum 30 and/or the rotator 100 in a state in which the uniformity of distribution is low, as a result of the controller 70 controlling the driver 50 at a target RPM, the actual RPM of the driver 50 may not follow the target RPM within a target time, or a change in the RPM, that is, an amplitude of the RPM may be formed.

The RPM may be calculated based on a result of rotation of the drum 30 or the rotator 100. A separate sensor for measuring the RPM of the driver 50 may be disposed, so that the controller 70 may receive a measurement value from the sensor.

In one example, a separate sensor for measuring vibration may be disposed in the driver 50, the drum 30, or the rotator 100, and the controller 70 may determine the uniformity of distribution of the laundry by receiving the vibration value from the sensor.

In one embodiment of the present disclosure, when the uniformity of distribution in the distribution determination process (P60) is equal to or lower than a reference uniformity, the controller 70 may control the driver 50 such that the rotator 100 performs the ascending motion M1 at least once after the distribution determination process (P60).

The reference uniformity, which is a standard for the uniformity of distribution, may be stored in the controller 70 in advance. Alternatively, a reference uniformity based on a current state may be calculated based on the amount of laundry or the like, or may be derived through a data map.

In one embodiment of the present disclosure, it may be indicated that, the higher the uniformity of distribution of the laundry, the more uniformly the laundry is distributed. As the uniformity of distribution of laundry is lower, the laundry may be non-uniformly distributed, and thus, a center of gravity thereof is biased to one side.

The reference uniformity is a value that means a state in which the uniformity of distribution of laundry is too low, and thus, the vibration, the noise, and the like of an amount equal to or higher than a reference value are generated during the rotation of the drum 30 and the rotator 100. The reference uniformity may be variously determined in consideration of actual results of repeated experiments and the like and control strategy aspects.

Referring to FIG. 17, the controller 70 may determine the uniformity of distribution of the laundry in the distribution determination process (P60). When the uniformity of distribution is equal to or lower than the reference uniformity, the rotator 100 may perform the ascending motion M1 to improve the uniformity of distribution.

The ascending motion M1 may form the ascending water flow as described above. The uniformity of distribution of the water or the laundry in the rotation direction of the rotator 100 and in the vertical direction of the drum 30 may be improved by the ascending motion M1.

For example, relatively heavy laundry inside the drum 30 is likely to be located at the lower portion of the drum 30 and relatively light laundry is likely to be located at the upper portion of the drum 30. When a weight deviation as described above occurs, the uniformity of distribution may be lowered.

In addition, the center of gravity of the laundry may be biased to one side from a center of the drum 30 based on a cross-section of the drum 30 as the cleaning process (P10) or the like proceeds.

The ascending motion M1 of the rotator 100 may induce a movement of the laundry in the vertical direction as well as the rotation direction of the rotator 100. The ascending motion M1 may be advantageous in improving the uniformity of distribution of the laundry on the cross-section of the drum 30 because the rotator 100 is rotated not only in said one direction C1, but also in the other direction C2.

In addition, through the ascending motion M1, the laundry at the lower portion of the drum 30 may be moved upward, the laundry at the upper portion of the drum 30 may be moved downward by interaction, and the heavy laundry at the lower portion of the drum 30 and the light laundry at the upper portion of the drum 30 may be moved to be mixed with each other, so that the ascending motion M1 may be advantageous in improving the uniformity of distribution.

In one embodiment of the present disclosure, the distribution determination process (P60) may be performed as needed in the cleaning process (P10), the rinsing process (P20), and the dehydration process (P30). FIG. 10 illustrates an example in which the distribution determination process (P60) is performed at the end of the cleaning process (P10), but the present disclosure is not necessarily limited thereto.

When the distribution determination process (P60) is performed at the end of the cleaning process (P10) as shown in FIG. 17, the uniformity of distribution of the laundry may be improved before the drainage process (P50), an efficiency of improving the uniformity of distribution may be increased because the water is contained inside the tub 20, and the vibration and the noise that may be generated in the rinsing process (P20) may be reduced in advance, which may be advantageous.

When the uniformity of distribution is lower than the reference uniformity, the controller 70 may control the driver 50 such that the rotator 100 performs the ascending motion M1 at least once. FIG. 17 illustrates an operation process in which a distribution improvement process (P70) in which the rotator 100 performs the ascending motion M1 as the uniformity of distribution is equal to or lower than the reference uniformity, and the drainage process (P50) are performed together.

A section in which the rotator 100 performs the ascending motion M1 by the distribution improvement process (P70) is indicated by a dotted line area. The distribution improvement process (P70) may be performed when the uniformity of distribution is equal to or lower than the reference uniformity, and may be performed before or simultaneously with the drainage process (P50).

In one example, FIG. 9 shows the descending motion M2 of the ascending and descending motion of the laundry treating apparatus 100 according to an embodiment of the present disclosure. Referring to FIG. 9, in one embodiment of the present disclosure, the ascending and descending motion includes the descending motion M2 for forming the descending water flow. The controller 70 may control the driver 50 such that, in the descending motion M2, the rotator 100 rotates in the other direction C2 by a third amount of rotation R3, and rotates in said one direction C1 by a fourth amount of rotation R4 smaller than the third amount of rotation R3.

In the descending motion M2, the amount of rotation in the other direction C2 is set to be greater than the amount of rotation in said one direction C1, so that the effect of the descending water flow may be ultimately induced. In the descending motion M2, the rotator 100 may be rotated by the third amount of rotation R3 in the other direction C2 and may be rotated by the fourth amount of rotation R4 in said one direction C1.

The third amount of rotation R3 may have a higher value than the fourth amount of rotation R4. For example, the third amount of rotation R3 may correspond to a rotation angle of 720 degrees of the rotator 100, and the fourth amount of rotation R4 may correspond to a rotation angle of 360 degrees of the rotator 100. The third amount of rotation R3 may be equal to or greater than 120% and equal to or smaller than 150% or equal to or greater than 150% and equal to or smaller than 200% of the fourth amount of rotation R4.

However, the rotation angles and a ratio relationship of the third amount of rotation R3 and the fourth amount of rotation R4 are only presented as an example for convenience of description, and do not limit the present disclosure. The rotation angles and the ratio relationship of the third amount of rotation R3 and the fourth amount of rotation R4 may be variously set as needed.

The first amount of rotation R1 and the second amount of rotation R2 in the ascending motion M1 are independent of the third amount of rotation R3 and the fourth amount of rotation R4. For example, the first amount of rotation R1 and the third amount of rotation R3 may be the same or different, and the second amount of rotation R2 and the fourth amount of rotation R4 may be the same or different.

However, the above numeric values are only presented as an example for convenience of description, and do not limit one embodiment of the present disclosure. A ratio between the rotation angle of the rotator 100 and the amount of rotation may be variously set as needed.

The descending motion M2 of the present disclosure may ultimately have an effect of forming the descending water flow as the rotation in the other direction C2 of the rotator 100 forming the descending water flow has the greater amount of rotation than the rotation in said one direction C1 forming the ascending water flow, and may improve a uniformity of distribution of the laundry and ameliorate the curling phenomenon of the laundry as the rotation in the other direction C2 and the rotation in said one direction C1 are performed together in one cycle.

FIG. 10 is a graph showing a change in the RPM of the rotator 100 based on the descending motion M2. A horizontal axis represents a time, and a vertical axis represents the RPM of the rotator 100. In the vertical axis, a positive value means the rotation in said one direction C1 of the rotator 100, and a negative value means the rotation in the other direction C2 of the rotator 100.

Referring to FIG. 10, in the descending motion M2, the rotator 100 may rotate in said one direction C1 by the fourth amount of rotation R4 and then rotate in the other direction C2 by the third amount of rotation R3. An order of the rotation in said one direction C1 and the rotation in the other direction C2 may be changed as needed.

The amount of rotation of the rotator 100 may be understood as product of the RPM and the time. That is, in FIG. 10, the amount of rotation of the rotator 100 may correspond to each area defined by being distinguished from each other by a line of the RPM and the horizontal axis. In the descending motion M2, in the rotator 100, the rotation in said one direction C1 and the rotation in the other direction C2 may have the same maximum RPM, and may have different rotation times.

However, the maximum RPMs of the rotation in said one direction C1 and the rotation in the other direction C2 may be set differently from each other as needed, and the rotation times thereof may also be variously set as needed.

In the descending motion M2, the rotator 100 may continuously rotate in the other direction C2 after rotating in said one direction C1, or may rotate in the other direction C2 after the stationary state where the RPM corresponds to 0 after the rotation in said one direction C1. The time required for the stationary state may vary as need.

In one example, in one embodiment of the present disclosure, the controller 70 may control the driver 50 such that the rotator 100 performs the descending motion M2 at least once only when the amount of water supplied to the tub 20 during the washing cycle (P100) is equal to or greater than a reference water supply amount.

In FIG. 1, a water surface based on the reference water supply amount is exemplarily indicated inside the tub 20. In one embodiment of the present disclosure, when the water supplied into the tub 20 is equal to or less than the reference water supply amount, the descending motion M2 of the rotator 100 may be limited in performance.

The descending motion M2 may move the laundry and the water downward around the pillar 150. In the case in which the water surface inside the tub 20 is too low, when the descending motion M2 is performed, a distance between the laundry and the bottom portion 110 or the bottom surface 33 of the drum 30 is too small, so that a flow efficiency of the laundry may be excessively reduced, and a phenomenon in which the laundry is jammed between the bottom portion 110 and the bottom surface 33 of the drum 30 may be induced, which may be disadvantageous.

Therefore, in one embodiment of the present disclosure, the flow of the laundry by the descending motion M2 may be effectively made, a standard of the water supply amount that may sufficiently suppress the jamming phenomenon of the laundry may be set as the reference water supply amount, and the descending motion M2 of the rotator 100 may be performed with the amount of water equal to or greater than the reference water supply amount.

The reference water supply amount may be determined as a result of a repeated experiment or a theoretical calculation result, and may be variously determined in a strategic aspect of the performance of the washing cycle (P100).

The controller 70 may determine the amount of water supplied to the tub 20 in various schemes. For example, a water supply amount based on a water supply execution time of the water supply 60 may be stored in the controller 70 in advance in a form of a data map, and the controller 70 may determine the water supply amount based on the data map.

Alternatively, the water supply 60 may be constructed such that the amount of water supplied for each unit time may be adjusted, and the controller 70 may adjust the amount of water supplied into the tub 20 while adjusting the amount of water supplied for each unit time together with the water supply time.

Alternatively, a water level sensor capable of measuring a water level may be disposed in the tub 20, and the controller 70 may identify the water supply amount through the water level with respect to the amount of water currently supplied through the water level sensor.

One embodiment of the present disclosure may effectively improve the washing efficiency by setting the reference water supply amount appropriate and efficient to perform the descending motion M2, and performing the descending motion M2 of the rotator 100 with the amount of water equal to or greater than the reference water supply amount.

FIG. 17 shows a plurality of dotted line regions in which the rotation motion of the rotator 100 is performed. A dotted line region in which the descending motion M2 may be performed with the amount of water equal to or greater than the reference water supply amount is indicated. The descending motion M2 may be used in the cleaning process (P10), the rinsing process, or the like.

However, the dotted line region shown in FIG. 17 is for convenience of description. The descending motion M2 may be performed various number of times in various sections in the washing cycle (P100).

Figure 11:
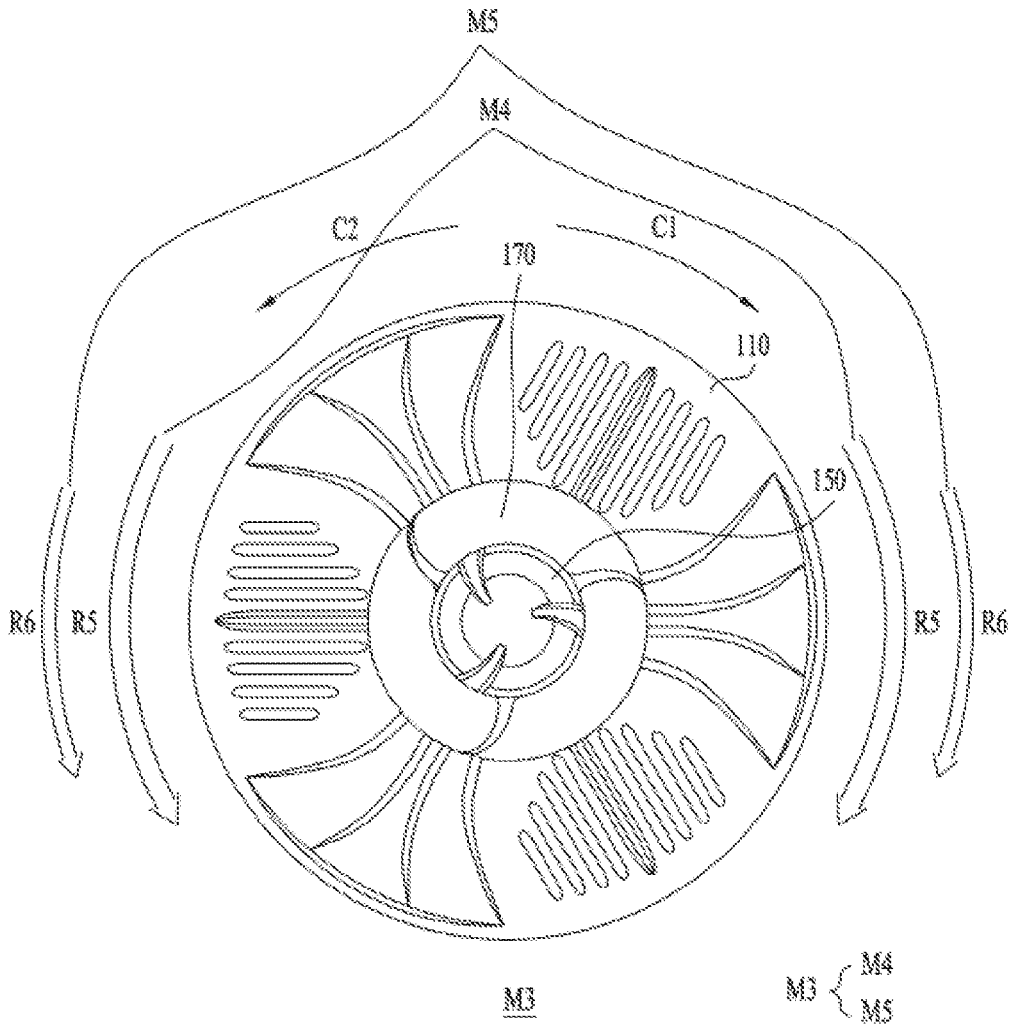
FIG. 11 is a view showing a power motion of a rotator in a laundry treating apparatus according to an embodiment of the present disclosure.

In one example, FIG. 11 shows the power motion M3 of the rotator 100 according to an embodiment of the present disclosure. Referring to FIG. 7, the controller 70 may control the driver 50 such that the rotator 100 performs the power motion M3 for forming a stronger water flow than the ascending and descending motion at least once in the washing cycle (P100).

In addition, the controller 70 may control the driver 50 such that, in the power motion M3, the rotator 100 continuously performs a strong rotation motion M4 in which the rotator 100 is rotated by a fifth amount of rotation R5 in each of said one direction C1 and the other direction C2, and a weak rotation motion M5 in which the rotator is rotated by a sixth amount of rotation R6 less than the fifth amount of rotation R5 in each of said one direction C1 and the other direction C2.

The rotation motion of the present disclosure may further include the power motion M3 in addition to the ascending and descending motion. The power motion M3 may be understood as a rotation motion intended to form the stronger water flow than the ascending and descending motion.

The power motion M3 may improve the effect of removing the foreign substances from the laundry in the cleaning process (P10) by forming the stronger water flow than the ascending and descending motion, and may be advantageous to separate the foreign substances or the detergent remaining in the laundry from the laundry or discharge the foreign substances or the detergent from the tub 20 in the rinsing process (P20).

The controller 70 may perform the power motion M3 more than once in the washing cycle (P100). In FIG. 10, a section in which the power motion M3 is performed according to an embodiment of the present disclosure is indicated by a dotted line area.

However, the section in which the power motion M3 is performed may not be limited as shown in FIG. 10, and may be performed various number of times in various processes and sections as needed. The rotator 100 may be rotated at least 4 times in one cycle of the power motion M3. The rotations may be divided based on a change in the rotation direction.

Referring to FIG. 11, in the power motion M3, the rotator 100 may perform both the strong rotation motion M4 and the weak rotation motion M5. The number of executions or the order of the strong rotation motion M4 and the weak rotation motion M5 may be variously set as needed.

In the strong rotation motion M4, the rotator 100 may be rotated by the fifth amount of rotation R5 in said one direction C1 and rotated by the fifth amount of rotation R5 in the other direction C2. The order of the rotation in said one direction C1 and the rotation in the other direction C2 may be determined as needed.

Figure 12:
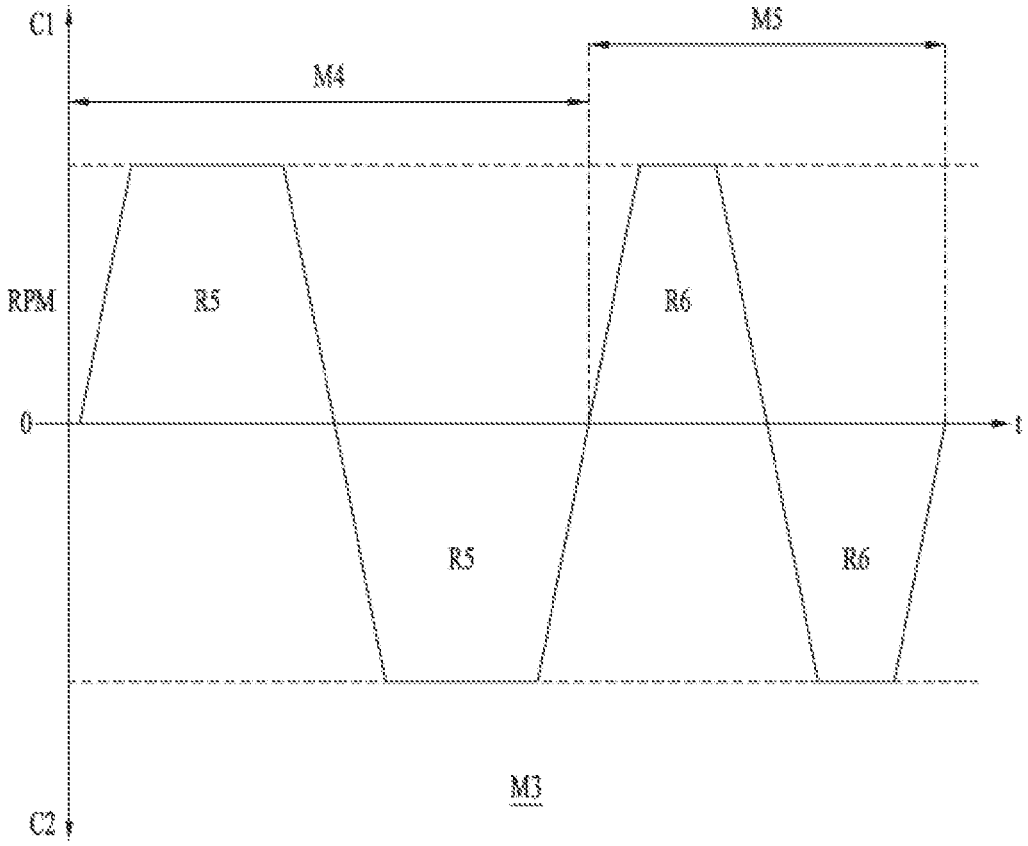
FIG. 12 is a graph showing an RPM of a rotator based on a power motion in a laundry treating apparatus according to an embodiment of the present disclosure.

FIG. 12 is a graph showing a change in the RPM of the rotator 100 based on the power motion M3. A horizontal axis represents a time, and the vertical axis represents the RPM of the rotator 100. In the vertical axis, a positive value means the rotation in said one direction C1 of the rotator 100, and a negative value means the rotation in the other direction C2 of the rotator 100.

Referring to FIG. 12, in the power motion M3, the rotator 100 may perform the weak rotation motion M5 of being rotated in each of said one direction C1 and the other direction C2 by the sixth amount of rotation R6 after performing the strong rotation motion M4 of being rotated in each of said one direction C1 and the other direction C2 by the fifth amount of rotation R5. In the strong rotation motion M4 and the weak rotation motion, an order of the rotation in said one direction C1 and the rotation in the other direction C2 may be changed as necessary.

In the power motion M3, in the rotator 100, the rotation in said one direction C1 and the rotation in the other direction C2 may have the same maximum RPM, but may have different rotation times.

However, the maximum RPMs of the rotation in said one direction C1 and the rotation in the other direction C2 may be set differently from each other as needed, and the rotation times thereof may also be variously set as needed.

In the power motion M3, the rotator 100 may continuously rotate in the other direction C2 after rotating in said one direction C1, or may rotate in the other direction C2 after the stationary state where the RPM corresponds to 0 after the rotation in said one direction C1. The time required for the stationary state may vary as need.

The fifth amount of rotation R5 may be the same as or different from the first amount of rotation R1 and the third amount of rotation R3 of the ascending and descending motion. For example, the fifth amount of rotation R5 may be equal to or greater than the first amount of rotation R1 and the third amount of rotation R3. In the strong rotation motion M4, the rotator 100 may form a relatively strong water flow with respect to that in the weak rotation motion M5 while rotating by the fifth amount of rotation R5 in said one direction C1 and the other direction C2.

In the strong rotation motion M4, the rotator 100 is rotated by the same amount of rotation in said one direction C1 and the other direction C2, so that it is not intended to form one of the ascending water flow and the descending water flow, and both the ascending water flow and the descending water flow are strongly formed in addition to the rotations in said one direction C1 and the other direction C2, thereby improving the washing effect.

In the power motion M3, the rotator 100 may perform the weak rotation motion M5 along with the strong rotation motion M4. In the weak rotation motion M5, the rotator 100 may perform the rotation in said one direction C1 and the rotation in the other direction C2, and the rotator 100 may be rotated by the sixth amount of rotation R6 in said one direction C1, and rotated by the sixth amount of rotation R6 in the other direction C2. In the weak rotation motion M5, the order of the rotation in said one direction C1 and the rotation in the other direction C2 may be variously determined.

The fifth amount of rotation R5 may have a higher value than the sixth amount of rotation R6. For example, the fifth amount of rotation R5 may correspond to a rotation angle of 720 degrees of the rotator 100, and the sixth amount of rotation R6 may correspond to a rotation angle of 360 degrees of the rotator 100. The fifth amount of rotation R5 may be equal to or greater than 120% and equal to or smaller than 150% or equal to or greater than 150% and equal to or smaller than 200% of the sixth amount of rotation R6.

However, the rotation angles and a ratio relationship of the fifth amount of rotation R5 and the sixth amount of rotation R6 are only presented as an example for convenience of description, and do not limit the present disclosure. The rotation angles and the ratio relationship of the fifth amount of rotation R5 and the sixth amount of rotation R6 may be variously set as needed.

The sixth amount of rotation R6 may be set independently set of the second amount of rotation R2 and the fourth amount of rotation R4 of the ascending and descending motion. For example, the sixth amount of rotation R6 may be the same as or different from the second amount of rotation R2 and the fourth amount of rotation R4. For example, the sixth amount of rotation R6 may be equal to or less than the second amount of rotation R2 and the fourth amount of rotation R4.

In addition, the execution order and the numbers of executions of the strong rotation motion M4 and the weak rotation motion M5 in the power motion M3 may be varied. For example, in the power motion M3, the rotator 100 may perform the weak rotation motion M5 after the strong rotation motion M4 is performed.

In the power motion M3, the rotation in said one direction C1 and the rotation in the other direction C2 of the rotator 100 are strongly made to increase the washing effect of the laundry in the strong rotation motion M4, and the rotation in said one direction C1 and the rotation in the other direction C2 of the rotator 100 are weakly made to ameliorate the curling phenomenon of the laundry while improving the uniformity of distribution of the laundry and suppress damage to the laundry in the weak rotation motion M5.

The fifth amount of rotation R5 and the sixth amount of rotation R6 may be defined as a concept including a rotation time for a rotation angle. For example, the fifth amount of rotation R5 may mean a certain rotation angle made within a certain time, and the sixth amount of rotation R6 may mean a rotation angle smaller than the certain rotation angle made within the certain time.

In one embodiment of the present disclosure, an rpm of the rotator 100 based on the fifth amount of rotation R5 may be set higher than an rpm of the rotator 100 based on the sixth amount of rotation R6, so that the washing effect of the laundry may be increased.

However, the time for the rotation may be set variously, and the rotation times of the fifth amount of rotation R5 and the sixth amount of rotation R6 may also be set to be different or the same. The first amount of rotation R1 to the fourth amount of rotation R4 may also be defined in the relationship of the rpm as described above.

In one example, in one embodiment of the present disclosure, the controller 70 may control the driver 50 such that the rotator 100 performs the weak rotation motion M5 after performing the strong rotation motion M4 in the power motion M3.

As described above, the rotator 100 may perform the strong rotation motion M4 in the power motion M3 to perform the washing motion with the increased washing effect, and then perform the weak rotation motion M5 to suppress the curling or the damage of the laundry.

In other words, in one embodiment of the present disclosure, the controller 70 may control the driver 50 such that, in the power motion M3, the rotator 100 is rotated by the fifth amount of rotation R5 in either of said one direction C1 or the other direction C2, then is rotated by the fifth amount of rotation R5 in the remaining direction, then is rotated by the sixth amount of rotation R6 in either of said one direction C1 or the other direction C2, and then, is rotated by the sixth amount of rotation R6 in the remaining direction.

For example, in the power motion M3, the rotator 100 may be rotated by the fifth amount of rotation R5 in said one direction C1 and then rotated by the fifth amount of rotation R5 in the other direction C2. Thereafter, the rotator 100 may be rotated by the sixth amount of rotation R6 in said one direction C1 and then rotated by the sixth amount of rotation R6 in the other direction C2.

In one example, as described above, one embodiment of the present disclosure may further include the detergent feeder 25 constructed to supply the detergent to be provided to the tub 20 and the water supply 60 constructed to provide the water to be supplied to the tub 20.

The washing process (P100) may include the cleaning process (P10) in which the detergent is put into the tub 20 from the detergent feeder 25 and the foreign substances on the clothes are removed, and the rinsing process (P20) in which the water is supplied from the water supply 60 to the tub 20 and the foreign substances are discharged from the tub 20.

The controller 70 may control the driver 50 such that the rotator 100 performs the power motion M3 at least once in the cleaning process (P10) or the rinsing process (P20).

The power motion M3 may increase the washing or rinsing effect by forming the three-dimensional and strong water flow through the strong rotation of the rotator 100, and may improve the washing efficiency by performing a weak rotation of the rotator 100 to suppress the curling phenomenon or the damage of the laundry.

Therefore, the controller 70 may control the rotator 100 or the driver 50 such that the power motion M3 is performed at least once in the cleaning process (P10) or the rinsing process (P20), thereby improving the washing efficiency.

In FIG. 17, the section in which the power motion M3 is performed according to an embodiment of the present disclosure is indicated by the dotted line area. However, the dotted line area shown in FIG. 10 is an example for convenience of description and the present disclosure is not necessarily limited thereto. The power motion M3 may be performed various number of times in various sections as needed.

In one example, the controller 70 may control the driver 50 such that the rotator 100 performs the ascending motion M1 at least once within the first reference time t1 after the termination of the water supply process P40, and performs the power motion M3 at least once after the first reference time t1.

As described above, the ascending motion M1 may effectively induce mixing between the laundry and the water or the detergent through the three-dimensional water flow formation after the water supply process (P40). After the ascending motion M1 is performed, the controller 70 controls the driver 50 such that the rotator 100 performs the power motion M3, so that the washing effect may be improved by forming the strong and three-dimensional water flow when the laundry and the water or the detergent are sufficiently mixed with each other.

FIG. 17 shows an operation process in the washing cycle (P100) in which the ascending motion M1 is performed during the first reference time t1 after the water supply process (P40), and the power motion M3 is performed after performing the ascending motion M1, according to one embodiment of the present disclosure.

In one example, in one embodiment of the present disclosure, the controller 70 may control the driver 50 such that, when the amount of water supplied from the water supply 60 to the tub 20 is equal to or greater than the reference water supply amount, the rotator 100 replaces the power motion M3 performed when the water supply amount is less than the reference water supply amount with the descending motion M2 at least once.

As described above, an efficiency of the descending motion M2 may be improved when the amount of water inside the tub 20 is equal to or greater than the reference water supply amount. Therefore, in one embodiment of the present disclosure, the power motion M3 may be performed when the amount of water is equal to or less than the reference water supply amount, and the descending motion M2 may be performed by replacing at least one cycle of the power motion M3 when the amount of water is equal to or greater than the reference water supply amount.

However, even when the amount of water is equal to or greater than the reference water supply amount, all power motion M3 does not necessarily have to be replaced with the descending motion M2, and the power motion M3 and the descending motion M2 may be performed in combination as needed. In FIG. 17, a section in which the power motion M3 and/or the descending motion M2 may be performed according to an embodiment of the present disclosure is shown as a dotted line area.

In one example, as described above, in one embodiment of the present disclosure, the drum 30 may be constructed to be rotatable inside the tub 20, and the driver 50 may be constructed to provide the rotational force to each of the rotator 100 and the drum 30.

The controller 70 may control the driver 50 such that basket motion M6 in which the rotator 100 and the drum 30 together are rotated by a seventh amount of rotation R7 in each of said one direction C1 and the other direction C2 in the washing cycle P100 is performed at least once.

Figure 13:
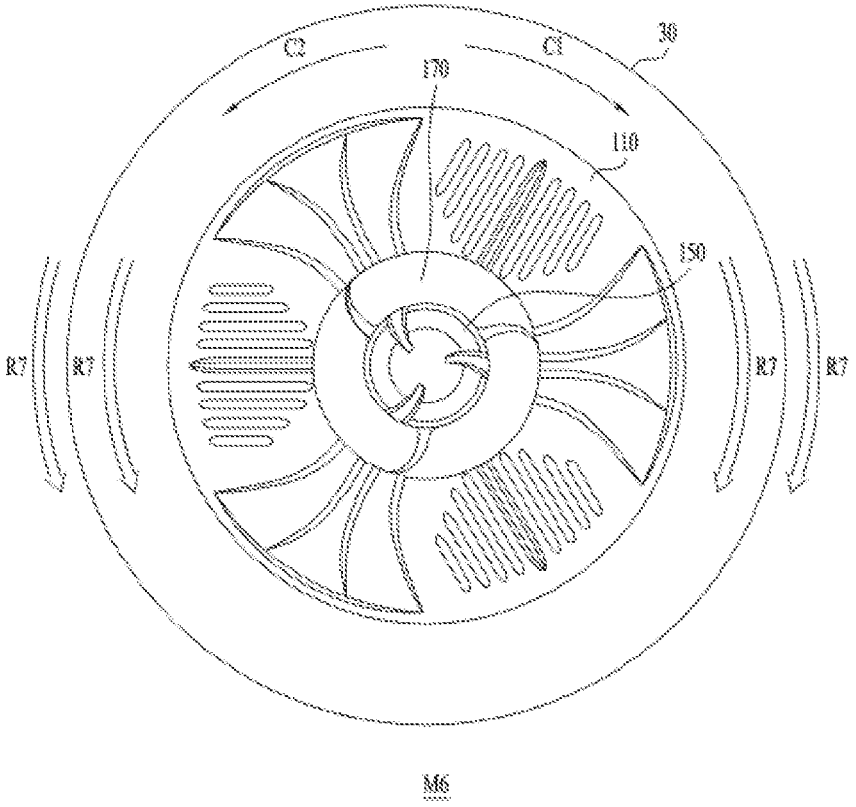
FIG. 13 is a view showing a basket motion of a rotator in a laundry treating apparatus according to an embodiment of the present disclosure.

FIG. 13 shows the basket motion M6 according to an embodiment of the present disclosure. In the basket motion M6, the drum 30 and the rotator 100 may be rotated together, and may be rotated in the same rotation direction as each other.

For example, the controller 70 may control the clutch element 46, for example, the second clutch element 48 to synchronize the rotations of the first rotation shaft 41 and the second rotation shaft 42 with each other, and control the driver 50 to rotate the drum 30 and the rotator 100 together.

In one cycle of the basket motion M6, the drum 30 and the rotator 100 may be rotated together in said one direction C1 by the seventh amount of rotation R7 and may be rotated in the other direction C2 by the seventh amount of rotation R7.

In the basket motion M6, the drum 30 and the rotator 100 may be rotated together to increase a centrifugal force acting on the laundry or to suppress the curling phenomenon of the laundry. The basket motion M6 may also improve permeability of the water to the laundry.

Figure 14:
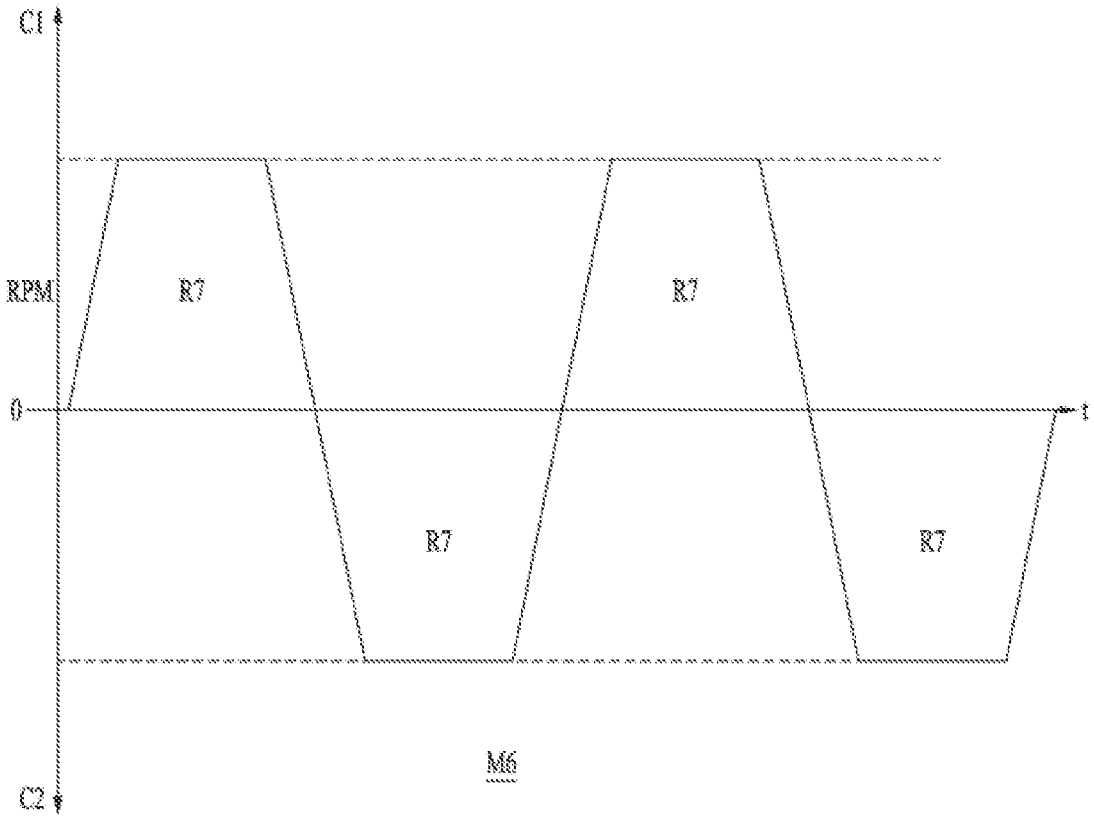
FIG. 14 is a graph showing an RPM of a rotator based on a basket motion in a laundry treating apparatus according to an embodiment of the present disclosure.

FIG. 14 is a graph showing a change in the RPM of the rotator 100 based on the basket motion M6. A horizontal axis represents a time, and the vertical axis represents the RPM of the rotator 100. In the vertical axis, a positive value means the rotation in said one direction C1 of the rotator 100, and a negative value means the rotation in the other direction C2 of the rotator 100.

Referring to FIG. 14, in the basket motion M6, the rotator 100 and the drum 30 may be rotated in each of said one direction C1 and the other direction C2 by the seventh amount of rotation R7. In the basket motion M6, an order of the rotation in said one direction C1 and the rotation in the other direction C2 may be changed as necessary.

In the basket motion M6, in the rotator 100, the rotation in said one direction C1 and the rotation in the other direction C2 may have the same maximum RPM, and may have the same rotation times.

However, the maximum RPMs of the rotation in said one direction C1 and the rotation in the other direction C2 may be set differently from each other as needed, and the rotation times thereof may also be variously set as needed.

In the basket motion M6, the rotator 100 may continuously rotate in the other direction C2 after rotating in said one direction C1, or may rotate in the other direction C2 after the stationary state where the RPM corresponds to 0 after the rotation in said one direction C1. The time required for the stationary state may vary as need.

The seventh amount of rotation R7, which is a rotation angle of the rotator 100, may correspond to 720 degrees. However, the seventh amount of rotation R7 is merely presented as an example for convenience of description, and does not limit the present disclosure, and may be variously set.

In one embodiment of the present disclosure, in the basket motion M6, the drum 30 and the rotator 100 may have the same amount of rotation in each of said one direction C1 and the other direction C2 as the seventh amount of rotation R7. The amounts of rotation in said one direction C1 and the other direction C2 may be set differently. The order of the rotation in said one direction C1 and the rotation in the other direction C2 may be varied as needed. In FIG. 17, a section in which the basket motion M6 may be performed according to an embodiment of the present disclosure is indicated by a dotted line area.

In one example, in one embodiment of the present disclosure, the washing cycle (P100) includes the dehydration process (P30) of removing the moisture from the laundry of the drum 30. The controller 70 may control the driver 50 such that the drum 30 and the rotator 100 perform the basket motion M6 together in the dehydration process P30.

As described above, in the basket motion M6, the drum 30 and the rotator 100 may be rotated together to increase the centrifugal force acting on the laundry inside the drum 30. One embodiment of the present disclosure may perform the basket motion M6 in the dehydration process (P30) to remove the moisture from the laundry.

Because the rotation in said one direction C1 and the rotation in the other direction C2 are done together, the basket motion M6 may remove the moisture from the laundry while preventing the moisture present in the laundry from being biased to one side, and may be used at the beginning of the dehydration process (P30). However, the present disclosure is not necessarily limited thereto, and the basket motion M6 may be used in various sections and processes as needed.

In FIG. 17, a section in which the basket motion M6 may be performed in the dehydration process (P30) according to an embodiment of the present disclosure is indicated by a dotted line area.

Figure 15:
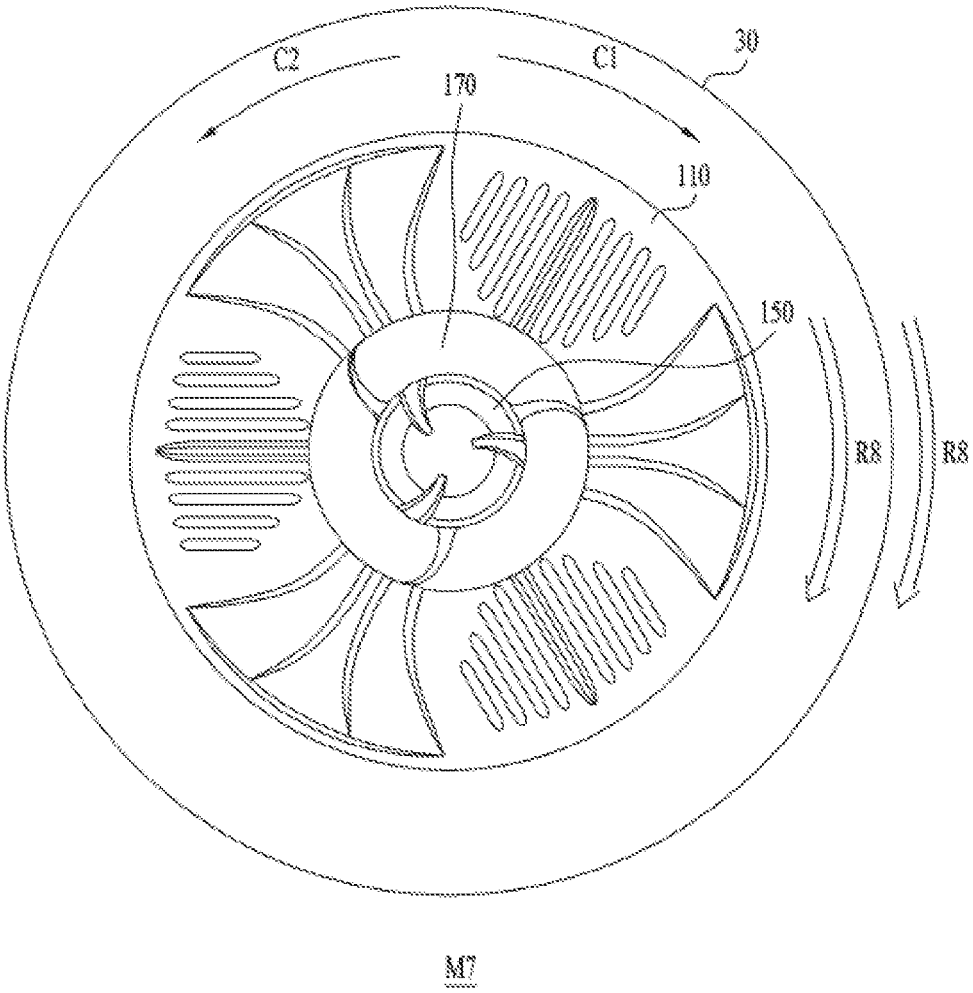
FIG. 15 is a view showing an alpha motion of a rotator in a laundry treating apparatus according to an embodiment of the present disclosure.

In one example, FIG. 15 shows an alpha motion M7 according to an embodiment of the present disclosure. Referring to FIG. 15, in one embodiment of the present disclosure, the controller 70 may control the driver 50 such that the alpha motion M7 in which the rotator 100 and the drum 30 are rotated together by an eighth amount of rotation R8 in one of said one direction C1 and the other direction C2 is performed at least once in the washing cycle (P100).

Unlike the basket motion M6, the alpha motion M7 may include only the rotation in one of said one direction C1 and the other direction C2 in one cycle. In the alpha motion M7, the drum 30 and the rotator 100 may be rotated together by the eighth amount of rotation R8.

The eighth amount of rotation R8 is set independently of the first amount of rotation R1 to the seventh amount of rotation R7. For example, the eighth amount of rotation R8 may correspond to a rotation angle greater than the first amount of rotation R1 to the seventh amount of rotation R7.

Figure 16:
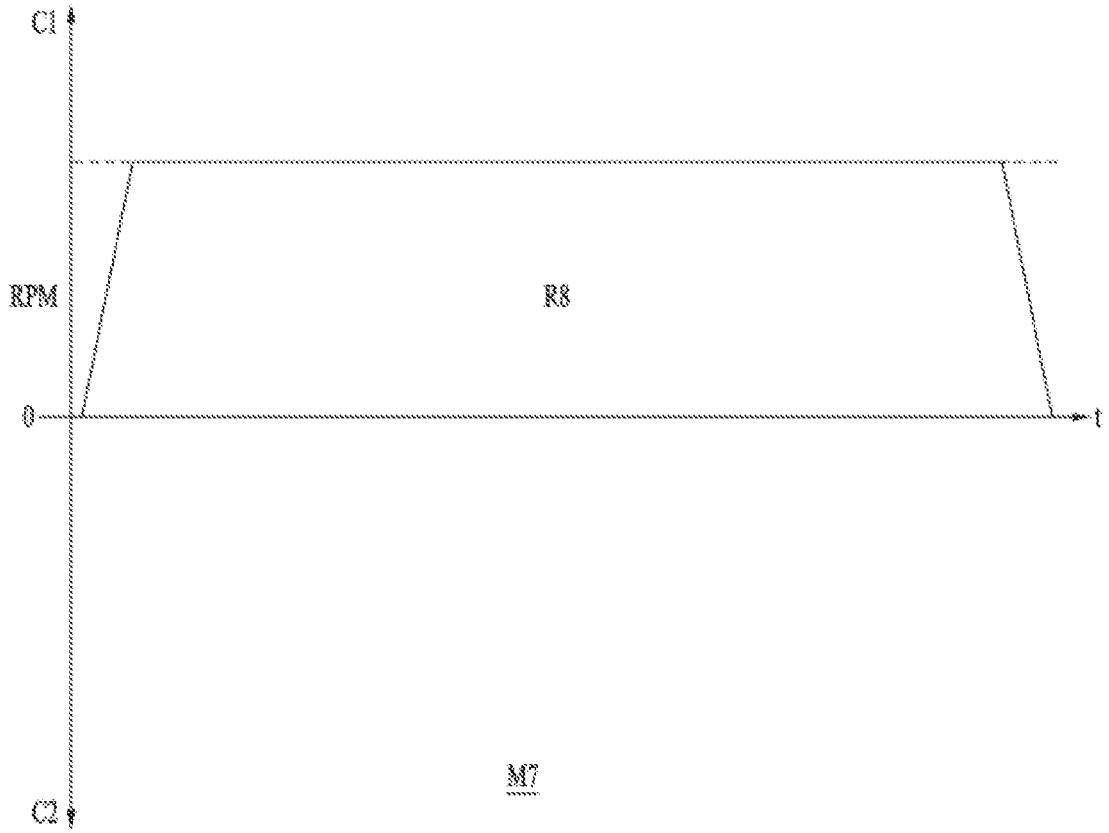
FIG. 16 is a graph showing an RPM of a rotator based on an alpha motion in a laundry treating apparatus according to an embodiment of the present disclosure.

FIG. 16 is a graph showing a change in the RPM of the rotator 100 based on the alpha motion M7. A horizontal axis represents a time, and a vertical axis represents the RPM of the rotator 100. In the vertical axis, a positive value means the rotation in said one direction C1 of the rotator 100, and a negative value means the rotation in the other direction C2 of the rotator 100.

Referring to FIG. 16, in the alpha motion M7, the rotator 100 and the drum 30 may be rotated by the eighth amount of rotation R8 in said one direction C1. However, this is only an example for convenience of description. In the alpha motion M7, the rotator 100 and the drum 30 may be rotated by the eighth amount of rotation R8 in the other direction C2. In the alpha motion M7, the maximum RPM of the rotation of the rotator 100 may be constantly maintained, and the rotation time may be variously set.

In the alpha motion M7, the drum 30 and the rotator 100 are rotated in only one direction, so that the centrifugal force acting on the laundry may be greatly increased, which may be advantageous for a large rotation angle, that is, for the drum 30 and the rotator 100 to continuously rotate a plurality of times.

Referring to FIG. 17, the washing cycle (P100) includes the dehydration process (P30) of removing the moisture from the laundry inside the drum 30. The controller 70 may control the driver 50 such that the drum 30 and the rotator 100 perform the alpha motion M7 together in the dehydration process P30.

It may be advantageous that a strong and continuous centrifugal force is provided to the laundry in the dehydration process (P30) to remove the moisture from the laundry. Therefore, in one embodiment of the present disclosure, the rotator 100 may perform the alpha motion M7 in the dehydration process (P30). The eighth amount of rotation R8 of the alpha motion M7 or the number of repetitions of the cycle may be variously set as needed.

Figure 18:
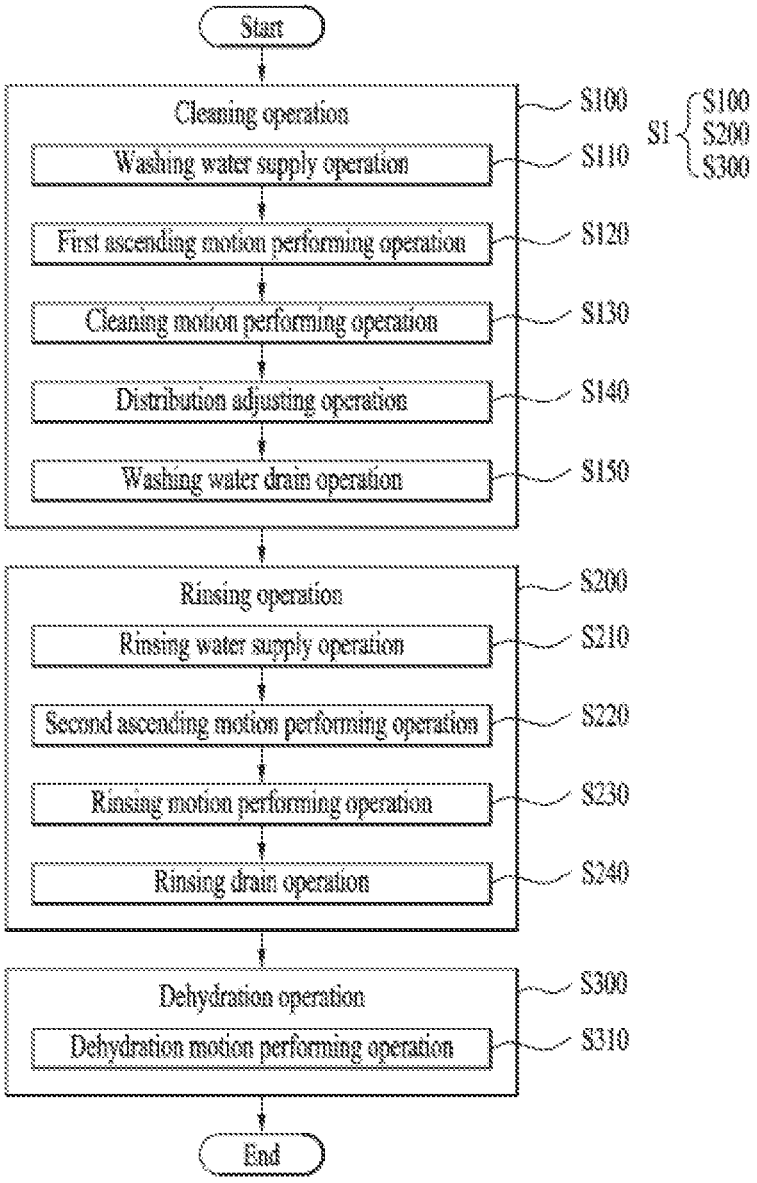
FIG. 18 is a flowchart illustrating a method for controlling a laundry treating apparatus according to an embodiment of the present disclosure.

In one example, FIG. 18 is a flowchart illustrating a method for controlling the laundry treating apparatus 1 according to an embodiment of the present disclosure. However, an order of operations in the flowchart shown in FIG. 18 is only shown as an example for convenience of description. Repetition or an order change of the operations may be made variously as needed.

As described above, in one embodiment of the present disclosure, the laundry treating apparatus 1 may include the tub 20 in which the water is stored, the drum 30 disposed inside the tub 20 and into which the clothes are put, the rotator 100 rotatably installed on the bottom surface 33 of the drum 30, the driver 50 that provides the rotational force to the rotator 100, and the controller 70 that controls the driver 50.

The rotator 100 may include the bottom portion 110 disposed on the bottom surface 33 of the drum 30, and the pillar 150 that protrudes upward from the bottom portion 110 and having the blade 170 disposed on the outer circumferential surface thereof. The blade 170 may extend obliquely with respect to the longitudinal direction L of the pillar 150 to form the ascending water flow when the rotator 100 rotates in said one direction C1 and form the descending water flow when the rotator 100 rotates in the other direction C2.

In one example, referring to FIG. 18, a method for controlling the laundry treating apparatus 1 according to an embodiment of the present disclosure may include a washing operation (S1). The washing operation (S1) may include a cleaning operation (S100), a rinsing operation (S200), and a dehydration operation (S300).

The cleaning operation (S100) may remove the foreign substances from the laundry put into the drum 30. The rinsing operation (S200) may discharge the foreign material from the tub 20 after the cleaning operation (S100). The dehydration operation (S300) may remove the moisture from the laundry after the rinsing operation (S200).

In the washing operation (S1), the controller 70 may control the driver 50 such that the rotator 100 performs the ascending and descending motion for forming the ascending water flow or the descending water flow. In the ascending and descending motion, the controller 70 may control the driver 50 such that the rotator 100 performs the rotation in said one direction C1 and the rotation in the other direction C2, but the amount of rotation in said one direction C1 and the amount of rotation in the other direction C2 are different.

Referring to FIG. 18, in the control method according to an embodiment of the present disclosure, in the cleaning operation (S100), the ascending motion M1 or the descending motion M2 may be performed in a first ascending motion performing operation (S120), a cleaning motion performing operation (S130), and/or a distribution adjusting operation (S140). In addition, in the rinsing operation (S200), the ascending motion M1 or the descending motion M2 may be performed in a second ascending motion performing operation (S220) and/or a rinsing motion performing operation (S230).

With reference to FIG. 18, the method for controlling the laundry treating apparatus according to an embodiment of the present disclosure will be described in detail.

The washing operation (S1) may include at least one of the cleaning operation (S100), the rinsing operation (S200), and the dehydration operation (S300). The cleaning operation (S100) may include at least one of a washing water supply operation (S110), a first ascending motion performing operation (S120), a cleaning motion performing operation (S130), a distribution adjusting operation (S140), and a washing water drain operation (S150).

In the washing water supply operation (S110), the water may be supplied into the tub 20 through the water supply 60, and the detergent may be supplied into the tub 20 through the detergent water supply 60. That is, in the washing water supply operation (S110), the water supply process (P40) and the detergent supply process may be performed.

In the first ascending motion performing operation (S120), the ascending motion (M1) of the rotator 100 may be performed, so that efficient mixing of the detergent, the water, and the laundry may be performed. In the cleaning motion performing operation (S130), the rotation motion of the rotator 100 that removes the foreign substances from the laundry through the detergent effect may be performed.

Figure 19:
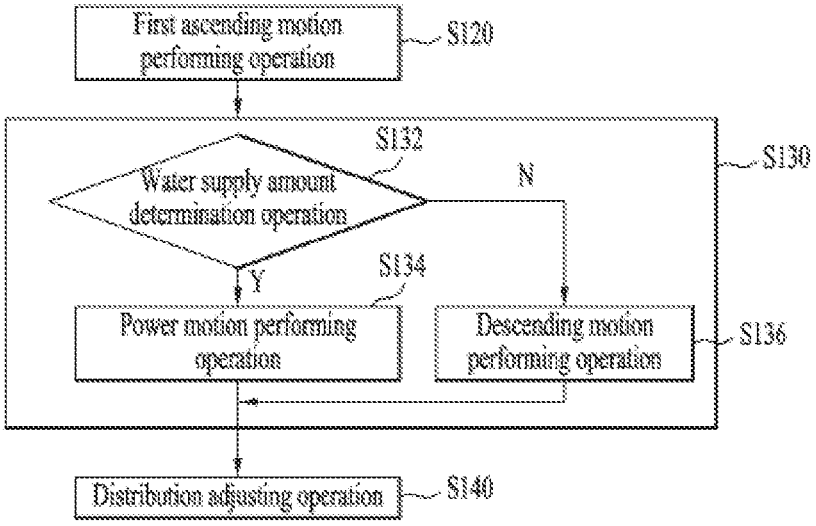
FIG. 19 is a flowchart illustrating a cleaning motion performing operation in a method for controlling a laundry treating apparatus according to an embodiment of the present disclosure.

For example, in the cleaning motion performing operation (S130), the power motion M3, the descending motion M2, or the like may be performed, and in addition, various rotation motions such as the ascending motion M1 may be performed. FIG. 19 shows a detailed flowchart of the cleaning motion performing operation (S130) in the method for controlling the laundry treating apparatus 1 according to an embodiment of the present disclosure.

Referring to FIG. 19, the cleaning motion performing operation (S130) may include a water supply amount determination operation (S132). In the water supply amount determination operation (S132), the controller 70 or the water supply 60 may determine the amount of water supplied into the tub 20 through the water supply time and the water supply amount for each unit time. In addition, the controller 70 may identify the water supply amount through the water level sensor.

In FIG. 19, the water supply amount determination operation is shown as a portion of the cleaning motion performing operation (S130), but this is only for convenience of description, and the present disclosure is not necessarily limited thereto. The water supply amount determination operation may be included in the washing water supply operation (S110), the first ascending motion performing operation (S120), or the like.

The controller 70 may determine whether the water supply amount is less than the reference water supply amount in the water supply amount determination operation (S132). When the water supply amount is less than the reference water supply amount, the power motion performing operation (S134) may be performed. When the water supply amount is equal to or greater than the reference water supply amount, the descending motion performing operation (S136) may be performed.

In the power motion performing operation (S134), the power motion M3 of the rotator 100 may be performed. In the descending motion performing operation (S136), the descending motion M2 of the rotator 100 may be performed. However, the power motion performing operation (S134) and the descending motion performing operation (S136) do not necessarily include one of the power motion M3 and the descending motion M2, and may further include the ascending motion M1 or the like.

Figure 20:
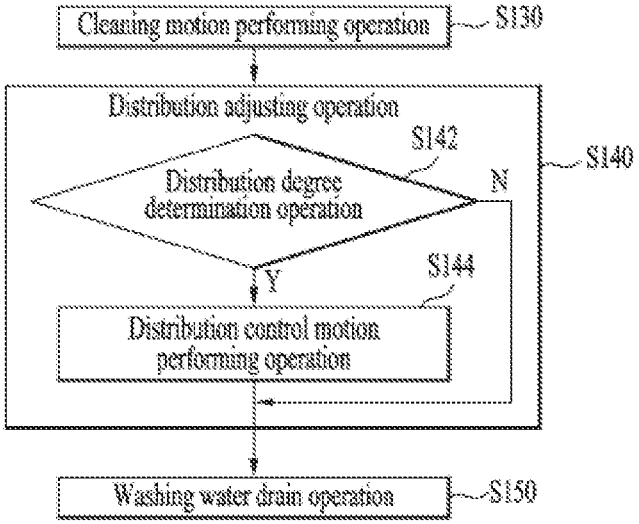
FIG. 20 is a flowchart illustrating a distribution adjusting operation in a method for controlling a laundry treating apparatus according to an embodiment of the present disclosure.

Referring back to FIG. 18, in one embodiment of the present disclosure, the distribution adjusting operation (S140) may be performed after the cleaning motion performing operation (S130). FIG. 20 is a detailed flowchart of the distribution adjusting operation (S140) according to an embodiment of the present disclosure.

Referring to FIG. 20, in the distribution adjusting operation (S140), the controller 70 may perform a distribution degree determination operation (S142). In the distribution degree determination operation (S142), the controller 70 may determine whether the uniformity of distribution of the laundry inside the drum 30 is equal to or less than the reference uniformity.

When the uniformity of distribution is equal to or less than the reference uniformity in the distribution degree determination operation (S142), a distribution adjusting motion performing operation (S144) may be performed. When the uniformity of distribution is greater than the reference uniformity, the distribution adjusting motion performing operation (S144) may be omitted and the washing water drain operation (S150) may be performed.

In the distribution adjusting motion performing operation (S144), the controller 70 may control the driver 50 to perform the distribution adjusting motion. The distribution adjusting motion may be the ascending motion M1 or the like.

Although not shown in FIG. 20, one embodiment of the present disclosure may further include a distribution degree re-determination operation after the distribution control motion performing operation (S144). In the distribution degree re-determination operation, the controller 70 may again determine whether the uniformity of distribution is equal to or less than the reference uniformity, and may perform the distribution control motion performing operation (S144) again when the uniformity of distribution is equal to or less than the reference uniformity, and may perform the washing water drain operation (S150) when the uniformity of distribution is greater than the reference uniformity.

Referring back to FIG. 18, the washing water drain operation (S150) may be performed after the distribution adjusting operation (S140) in the cleaning operation (S100). In the washing water drain operation (S150), the water inside the tub 20 may be discharged to the outside through the drain 65. In the cleaning operation (S100), the washing water supply operation (S110) and the washing water drain operation (S150) may be performed various number of times and in various orders as needed.

In one example, the rinsing operation (S200) may include a rinsing water supply operation (S210), a second ascending motion performing operation (S220), a rinsing motion performing operation (S230), and a rinsing drain operation (S240).

In the rinsing water supply operation (S210), the water may be supplied into the tub 20 by the water supply 60. In the second ascending motion performing operation (S220), the ascending motion M1 of the rotator 100 may be performed. In the rinsing motion performing operation (S230), the power motion M3, the descending motion M2, or the like may be performed. In the rinsing drain operation (S240), the water inside the tub 20 may be discharged to the outside.

The dehydration operation (S300) may include a dehydration motion performing operation (S310). In the dehydration motion performing operation (S310), the moisture of the laundry may be removed by performing the basket motion M6, the alpha motion M7, or the like.

Although the present disclosure has been illustrated and described with reference to specific embodiments, but it will be apparent to those of ordinary skill in the art that the present disclosure may be variously improved and changed without departing from the spirit of the present invention provided by the following claims.

What is claimed is:

1. A laundry treating apparatus comprising:

a tub configured to receive water;

a drum rotatably disposed inside the tub, the drum having an open top surface configured to receive laundry therethrough;

a rotator rotatably disposed at a bottom surface of the drum;

a driver configured to provide a rotational force to the rotator; and a controller configured to control the driver, wherein the rotator comprises:

a bottom portion positioned at the bottom surface of the drum, a pillar that protrudes upward from the bottom portion, and a blade that is disposed at an outer circumferential surface of the pillar and extends obliquely with respect to a longitudinal direction of the pillar, the blade being configured to generate an ascending water flow based on the rotator rotating in a first direction and to generate a descending water flow based on the rotator rotating in a second direction opposite to the first direction, wherein the controller is configured to:

perform a washing cycle of the laundry, and during the washing cycle, control the driver to cause the rotator to perform an ascending and descending motion operation for generating the ascending water flow or the descending water flow in the drum, wherein the ascending and descending motion operation includes (i) an ascending motion operation for generating the ascending water flow and (ii) a descending motion operation for generating the descending water flow, wherein the ascending motion operation:

rotating the rotator in the first direction by a first rotation amount, and rotating the rotator in the second direction opposite to the first direction by a second rotation amount that is different from the first rotation amount, and wherein the descending motion operation comprises:

rotating the rotator in the second direction by a third rotation amount in the second direction, and rotating the rotator in the first direction by a fourth rotation amount that is less than the third rotation amount.

2. The laundry treating apparatus of claim 1, wherein the second rotation amount is less than the first rotation amount in the ascending motion operation.

3. The laundry treating apparatus of claim 2, further comprising a detergent feeder configured to supply detergent to the tub, wherein the washing cycle includes a cleaning process for removing foreign substances from the laundry, the cleaning process including supplying the detergent to the tub from the detergent feeder, and wherein the controller is configured to control the driver to cause the rotator to perform the ascending motion operation within a first reference time from a start point of the cleaning process.

4. The laundry treating apparatus of claim 3, further comprising a water supply configured to supply water to the tub, wherein the washing cycle further includes a rinsing process, the rinsing process including supplying water to the tub from the water supply and discharging the foreign substances from the tub after the cleaning process, and wherein the controller is configured to control the driver to cause the rotator to perform the ascending motion operation within a second reference time from a start point of the rinsing process.

5. The laundry treating apparatus of claim 2, further comprising a water supply configured to supply water to the tub, wherein the washing cycle includes at least one water supply process for supplying water into the tub through the water supply, and wherein the controller is configured to control the driver to cause the rotator to perform the ascending motion operation within a reference time from an end point of the at least one water supply process.

6. The laundry treating apparatus of claim 2, wherein the controller is configured to:

determine a uniformity of distribution of the laundry inside the drum; and based on determining that the uniformity of distribution is less than or equal to a reference uniformity, control the driver to cause the rotator to perform the ascending motion operation.

7. The laundry treating apparatus of claim 1, further comprising a water supply configured to water to the tub, and wherein the controller is configured to, based on an amount of water supplied to the tub during the washing cycle being greater than or equal to a reference water supply amount, control the driver to cause the rotator to perform the descending motion operation.

8. The laundry treating apparatus of claim 1, wherein the controller is configured to control the driver to cause the rotator to perform a power motion operation during the washing cycle to thereby generate a water flow that is greater than a water flow in the ascending and descending motion operation, wherein the power motion operation comprises:

a first rotation motion operation comprising rotating the rotator by a first power rotation amount in each of the first direction and the second direction, and a second rotation motion operation comprising rotating the rotator by a second power rotation amount in each of the first direction and the second direction, the second power rotation amount being less than the first power rotation amount, and wherein the controller is configured to control the driver to cause the rotator to perform the first rotation motion operation and the second rotation motion operation consecutively during the power motion operation.

9. The laundry treating apparatus of claim 8, wherein the controller is configured to:

in the first rotation motion operation, control the driver to rotate the rotator in one of the first direction or the second direction by the first power rotation amount, and then to rotate the rotator in the other of the first direction or the second direction by the first power rotation amount; and in the second rotation motion operation, control the driver to rotate the rotator in one of the first direction or the second direction by the second power rotation amount, and then to rotate the rotator in the other of the first direction or the second direction by the second power rotation amount.

10. The laundry treating apparatus of claim 8, further comprising:

a detergent feeder configured to supply detergent to the tub; and a water supply configured to supply water to the tub, wherein the washing cycle includes:

a cleaning process for removing foreign substances from the laundry, the cleaning process including supplying the detergent to the tub from the detergent feeder, and a rinsing process including supplying water to the tub from the water supply and discharging the foreign substances from the tub, and wherein the controller is configured to control the driver to cause the rotator to perform the power motion operation in the cleaning process or in the rinsing process.

11. The laundry treating apparatus of claim 8, further comprising a water supply configured to supply water to the tub, wherein the washing cycle includes at least one water supply process for supplying water into the tub through the water supply, and wherein the controller is configured to control the driver to cause the rotator (i) to perform the ascending motion operation within a first reference time after the at least one water supply process is terminated and (ii) to perform the power motion operation after the first reference time after the at least one water supply process is terminated.

12. The laundry treating apparatus of claim 8, further comprising a water supply configured to supply water to the tub, wherein the controller is configured to:

based on an amount of water supplied to the tub being less than a reference water supply amount, control the driver to cause the rotator to perform at least one cycle of the power motion operation, and based on the amount of water supplied to the tub being greater than or equal to the reference water supply amount, replace the at least one cycle of the power motion operation with the descending motion operation.

13. The laundry treating apparatus of claim 1, wherein the driver is configured to provide the rotational force to each of the rotator and the drum, and wherein the controller is configured to control the driver to cause the rotator and the drum to perform a basket motion operation during the washing cycle, the basket motion operation including rotating the rotator and the drum together in each of the first direction and the second direction.

14. The laundry treating apparatus of claim 13, further comprising:

a first rotation shaft connected to the drum;

a second rotation shaft connected to the rotator; and a gear set connected to the driver, the first rotation shaft, and the second rotation shaft, the gear set being configured to transmit power of the driver to the first rotation shaft and the second rotation shaft, wherein the gear set comprises a clutch element configured to selectively couple the first rotation shaft to the second rotation shaft, and wherein the controller is configured to control rotation directions of the drum and the rotator by controlling the clutch element.

15. The laundry treating apparatus of claim 13, wherein the washing cycle includes a dehydration process for removing moisture from the laundry in the drum, and wherein the controller is configured to control the driver to cause the drum and the rotator to perform the basket motion operation during the dehydration process.

16. The laundry treating apparatus of claim 1, wherein the driver is configured to provide the rotational force to each of the rotator and the drum, and wherein the controller is configured to control the driver to cause the rotator and the drum to perform an alpha motion operation during the washing cycle, the alpha motion operation including rotating the rotator and the drum together in one of the first direction or the second direction.

17. The laundry treating apparatus of claim 16, wherein the washing cycle includes a dehydration process for removing moisture from the laundry in the drum, and wherein the controller is configured to control the driver to cause the drum and the rotator to perform the alpha motion operation in the dehydration process.

18. A method for controlling a laundry treating apparatus including a tub configured to receive water, a drum rotatably disposed inside the tub and configured to receive laundry, a rotator rotatably disposed at a bottom surface of the drum, a driver configured to provide a rotational force to the rotator, and a controller configured to control the driver, the rotator including a bottom portion positioned at the bottom surface of the drum, a pillar that protrudes upward from the bottom portion, and a blade that is disposed at an outer circumferential surface of the pillar and that extends obliquely with respect to a longitudinal direction of the pillar, the blade being configured to generate an ascending water flow based on the rotator rotating in a first direction and to generate a descending water flow based on the rotator rotating in a second direction opposite to the first direction, the method comprising:

performing a washing operation, the washing operation including at least one of a cleaning operation for removing foreign substances from the laundry in the drum, a rinsing operation for discharging the foreign substances from the tub after the cleaning operation, and a dehydration operation for removing moisture from the laundry after the rinsing operation; and during the washing operation, controlling the driver to cause the rotator to perform an ascending and descending motion operation for generating the ascending water flow or the descending water flow, wherein the ascending and descending motion operation includes (i) an ascending motion operation for generating the ascending water flow and (ii) a descending motion operation for generating the descending water flow, wherein the ascending motion operation comprises:

rotating the rotator in the first direction by a first rotation amount, and rotating the rotator in the second direction by a second rotation amount different from the first rotation amount, and wherein the descending motion operation comprises:

rotating the rotator in the second direction by a third rotation amount in the second direction, and rotating the rotator in the first direction by a fourth rotation amount that is less than the third rotation amount.

* * * * *